US005694153A

United States Patent [19]

Aoyagi et al.

[11] Patent Number: 5,694,153

[45] Date of Patent: Dec. 2, 1997

[54] INPUT DEVICE FOR PROVIDING MULTI-DIMENSIONAL POSITION COORDINATE SIGNALS TO A COMPUTER

[75] Inventors: Tetsuji Aoyagi, Kanagawa; Takeshi Miura, Aomori; Hajime Suzuki, Kanagawa, all of Japan; Russell I. Sanchez, Seattle; Mark K. Svancarek, Redmond, both of Wash.; Toru Suzuki, Kanagawa, Japan; Mike M. Paull, Seattle, Wash.

[73] Assignee: Microsoft Corporation, Redmond, Wash.

[21] Appl. No.: 509,082

[22] Filed: Jul. 31, 1995

[51] Int. Cl.[6] ..... G09G 5/08

[52] U.S. Cl. ..... 345/161; 345/156

[58] Field of Search ..... 345/156, 157, 345/158, 161; 74/471 XY, 471 R; 273/148 B, 438; 341/20, 21; 250/22

[56] References Cited

U.S. PATENT DOCUMENTS

| | | | |
|---|---|---|---|
| D. 281,776 | 12/1985 | Griffin | D13/32 |
| D. 291,318 | 8/1987 | Kim | D14/114 |
| D. 302,010 | 7/1989 | McLaughlin et al. | D14/114 |
| D. 315,896 | 4/1991 | Brown | D14/100 |
| 3,643,148 | 2/1972 | Brown et al. | 318/628 |
| 4,180,860 | 12/1979 | Driscoll et al. | 364/900 |
| 4,464,652 | 8/1984 | Lapson et al. | 340/710 |
| 4,533,827 | 8/1985 | Fincher | 250/221 |
| 4,533,830 | 8/1985 | Beauprey | 250/231 |
| 4,538,476 | 9/1985 | Luque | 74/471 |
| 4,550,250 | 10/1985 | Mueller et al. | 250/203 |

(List continued on next page.)

FOREIGN PATENT DOCUMENTS

| | | | |
|---|---|---|---|
| 35 43 783 | 6/1987 | Germany . | |
| 38 30 520 | 3/1990 | Germany . | |
| 06 119105 | 7/1994 | Japan . | |
| 1 472 066 | 4/1977 | United Kingdom . | |
| WO 93/11526 | 6/1993 | WIPO | G09G 3/02 |

OTHER PUBLICATIONS

"IBM Game Control Adapter," Personal Computer Hardware Reference Library, International Business Machines Corporation, pp. 1–9.

"FastTRAP," MicroSpeed Incorporated, Fremont, California, 1987.

"The Evolving Mouse," *PC Magazine*, p. 250, Jan. 11, 1994.

Grabowski, Ralph, "Z Mouse Gives CAD Designers 3–D Control," *Infoworld*, p. 93, Jul. 13, 1992.

Venolia, Dan, "Facile 3D Direct Manipulation," Apple Computer Inc., Cupertino, California, Apr. 24–29, 1993, pp. 31–36.

(List continued on next page.)

*Primary Examiner*—Chanh Nguyen

*Attorney, Agent, or Firm*—Seed and Berry LLP

[57] ABSTRACT

A user input system for inputting computer signals, such as a joystick, has an elongated member or handle that is movably received by a housing. The handle is capable of moving in at least three perpendicular directions, i.e., along X, Y and Z axes, and is capable of being rotated about at least one of the three axes. In a first embodiment, a pair of light emitting diodes ("LEDs") are mounted at an end of the handle and oriented toward the interior of the housing. The LEDs are strobed to alternately project light downward into the housing. A light detecting element, such as a two-dimensional position sensing device ("PSD"), two one-dimension PSDs, or a four quadrant photodiode, is positioned opposite the LEDs, and mounted to the housing to receive the light from the LEDs to produce signals. The signals are converted from analog to digital and input to a microprocessor. The microprocessor, employing trigonometric methods, calculates the position and orientation (i.e., rotation) of the handle and outputs the coordinates to a host computer. The joystick preferably includes switches that produce signals and a slidable member that produces a variable signal, all of which are also output to the computer. In a second embodiment, the LEDs are mounted to the housing to project the light upward and the light detecting unit is mounted at the end of the handle.

38 Claims, 13 Drawing Sheets

U.S. PATENT DOCUMENTS

| | | | |
|---|---|---|---|
| 4,573,925 | 3/1986 | Styers | 434/49 |
| 4,578,674 | 3/1986 | Baker et al. | 340/710 |
| 4,682,159 | 7/1987 | Davison | 340/709 |
| 4,688,933 | 8/1987 | Lapeyre | 356/1 |
| 4,698,626 | 10/1987 | Sato et al. | 340/710 |
| 4,736,191 | 4/1988 | Matzke et al. | 340/365 |
| 4,782,335 | 11/1988 | Gussin | 340/709 |
| 4,786,892 | 11/1988 | Kubo et al. | 340/365 R |
| 4,823,634 | 4/1989 | Culver | 74/471 |
| 4,917,516 | 4/1990 | Retter | 400/489 |
| 4,949,080 | 8/1990 | Mikan | 340/711 |
| 5,045,843 | 9/1991 | Hansen | 340/709 |
| 5,142,506 | 8/1992 | Edwards | 367/127 |
| 5,166,668 | 11/1992 | Aoyagi | 340/710 |
| 5,186,629 | 2/1993 | Rohen | 434/114 |
| 5,204,947 | 4/1993 | Bernstein et al. | 395/157 |
| 5,298,919 | 3/1994 | Chang | 345/163 |
| 5,313,230 | 5/1994 | Venolia et al. | 345/163 |
| 5,389,950 | 2/1995 | Bouton | 345/156 |
| 5,510,893 | 4/1996 | Suzuki . | |
| 5,532,476 | 7/1996 | Mikan | 250/221 |

OTHER PUBLICATIONS

The New York Times, "AT&T Seeks Role in Pen Computing," *Bellevue Journal American,* Aug. 16, 1993.

Welch, Nathalie, "Hawkeye Zooms in on Mac Screens with Wireless Infrared Penlight Pointer," Pointer Systems, Inc., Burlington, Vermont.

"The DynaSight™ Sensor Developer's Kit," Origin Instruments Corporation, Grand Prairie, Texas, Oct. 1, 1992.

"Freepoint™ Cordless Pen Mouse," Data Stream Corporation (S) Pte Ltd, Singapore, Nov. 1992.

"Freepoint™ Reference Guide," Data Stream Corporation (S) Pte Ltd, Singapore, Oct. 1992.

Fig. 14
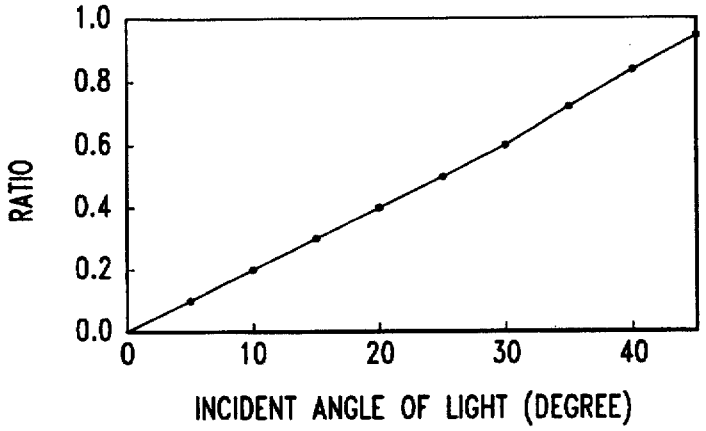
Fig. 16
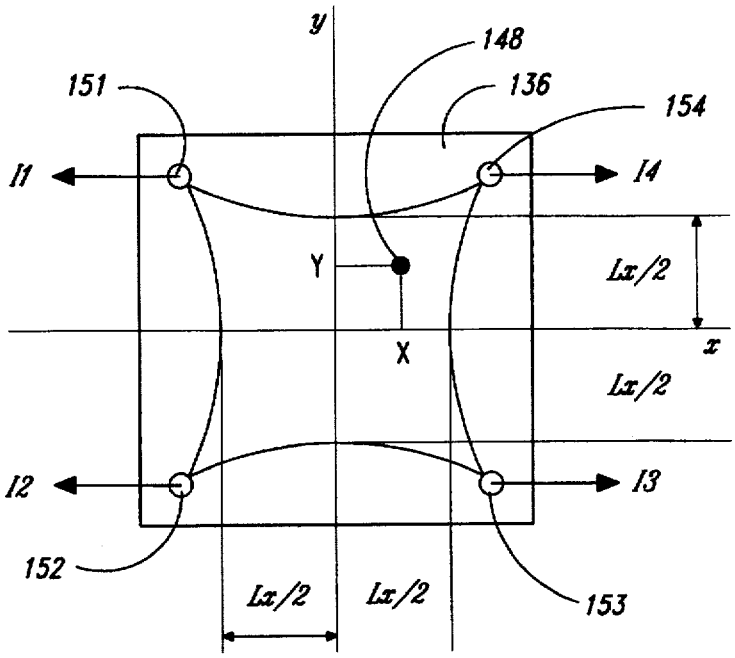
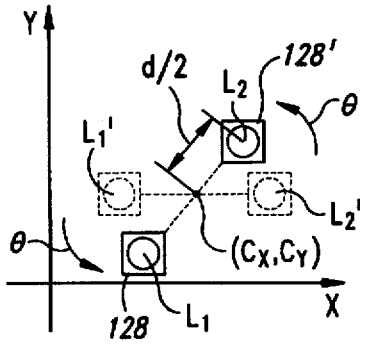
Fig. 18A
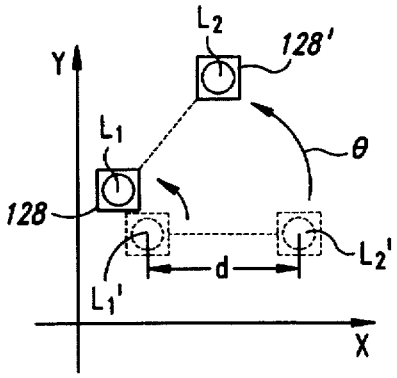
Fig. 18B

INPUT DEVICE FOR PROVIDING MULTI-DIMENSIONAL POSITION COORDINATE SIGNALS TO A COMPUTER

TECHNICAL FIELD

The present invention relates to the field of computer input devices.

BACKGROUND OF THE INVENTION

Cursor movement in most of today's computers is controlled using input devices such as mice or trackballs. Mice and trackballs both include a housing partially enclosing a rotatable ball and have one or more depressable buttons. Electronic encoders sense the rotation of the ball and generate signals indicating the ball's rotation. These signals are used to control two-dimensional movement of a cursor on a display screen. U.S. Pat. Nos. 5,298,919 to Chang and 5,313,230 to Venolia et al. describe mice capable of providing signals to control three-dimensional position signals that permit illusory positioning of a cursor in three-dimensional space on a two-dimensional video display device. The patents disclose mouse-type input devices having a rotatable ball and a thumb wheel for providing input signals representing three-dimensional movement.

Movement of a mouse in two directions on a tabletop or other surface by a user generates signals output to a computer, which result in corresponding movement of the cursor, provides an intuitive computer input device for a user. If a user desires to move through illusory three-dimensional space on a two-dimensional video display device, the prior art mice having thumbwheels fail to provide a sufficiently intuitive input device. Rotation of the thumbwheel, which provides corresponding virtual movement of a cursor or other object along an axis perpendicular to the video display device, fails to provide a sufficiently intuitive input to the user for virtual movement perpendicular to the display device.

Many of today's computer software applications, particularly games, accept input signals from mice, keyboards and other computer input devices such as joysticks. Joysticks provide two-dimensional position signals based on wrist movement. Joysticks provide a particularly intuitive way of providing position signals that correspond to movement either within the plane of the computer screen, or movement perpendicular to the plane of the computer screen (i.e., virtual movement into and out of the screen). Generally, left-right movement corresponds to left-right movement of a game player or object of a computer game in the plane of the computer screen. Similarly, forward-backward movement of the handle corresponds to either up-down movement or virtual movement into and out of the plane of the computer screen. Consequently, movement of the handle translates into two-dimensional movement on the computer screen.

Joysticks provide a varying resistance or voltage value that can be converted to absolute, as opposed to relative, position signals by additional circuitry or a computer to which the joystick is connected. In other words, the joystick generally provides a unique position signal for each position of the handle. Therefore, if the joystick, and the computer to which it is coupled, is powered down and then restarted, the joystick would still provide the same position signals. In contrast, mice typically provide relative position signals (in the form of "counts") that are used to generate quadrature signals. The counts are used to determine the magnitude and direction of mouse travel. However, the counts typically do not provide an absolute position with respect to a surface on which the mouse moves.

Joysticks typically employ variable resistors or potentiometers to provide the absolute position signals. The variable resistors provide variable analog signals based on movement of the joystick's handle. Variable resistors typically use mechanical/electrical contacts that are prone to deterioration from rotation and wear. Additionally, the signals output from variable resistors typically suffer from fluctuations based on changes in temperature and humidity. The signals output from variable resistors also vary over time as a result of wear and mechanical stress on the variable resistor. As a result, joysticks employing variable resistors are unreliable and not durable.

As a result of such changes in the signals output from joysticks, current joysticks include circuitry, such as trimming potentiometers, or software routines that calibrate a given joystick to establish a "center" position for the stick. Such additional circuitry or routines also allow a user to compensate for changes in the joystick due to temperature, humidity, wear, etc. Such additional circuitry or routines add to the complexity, and thus cost, of current joysticks. Such joysticks require the computer, or specialized circuitry, to which a joystick is coupled to convert the variable resistance or voltage value into position coordinates. This conversion imposes overhead on the host computer or specialized circuitry, and thus movement speed of the joystick is limited by the speed of the host computer or specialized circuitry to which the joystick is coupled.

Joysticks typically provide signals corresponding to only two-dimensional movement. Published European Patent Application WO 93/11526 describes a computer input device that permits three-dimensional movement of the device to generate signals corresponding to three-dimensional movement. The application describes a computer input device that uses a stationary transmitter and a hard operated, movable receiver. The transmitter includes three speakers spaced apart in an "L" or "T" shape. The movable receiver includes three microphones spaced apart in a triangular shape. Speakers transmit ultrasonic signals, which are received by the microphones. A calibration microphone is also included on the receiver. Control circuitry measures the time of delay for sound to travel from each of the three speakers in the transmitter to each of the three microphones in the receiver. From this delay information and the speed of sound in air (calibrated for that time and location), the device determines the three-dimensional position of the movable receiver with respect to the stationary transmitter. Sophisticated electronics and expensive components are required in this three-dimensional computer input device to perform the position/attitude computations.

Overall, the inventors are unaware of a reliable and durable joystick or "input device" that eliminates the need for variable resistors or complex mechanical transducers. Additionally, the inventors are unaware of any joystick-type input device that provides three-dimensional position signals. Furthermore, the inventors are unaware of any three-dimensional computer input device that avoids sophisticated electronics and expensive components yet provides accurate three-dimensional position signals. Moreover, the inventors are unaware of a joystick-type computer input device that mechanically separates the components that move with the handle from the components that provide position signals so as to enhance reliability and durability.

SUMMARY OF THE INVENTION

In a broad sense, the present invention embodies an input apparatus for providing absolute position signals. The input apparatus includes a stationary housing and a movable member. The movable member is movable in at least three degrees of freedom. An optical transducer has a first portion that includes first and second light emitting elements, and a second portion that includes at least one light detecting element. One of the first and second portions of the optical transducer is positioned within the stationary housing, while the other of the first and second portions is retained by the movable member.

The first and second light emitting elements project light so as to produce respective first and second areas of light on a surface of the light detecting element. The light detecting element detects the first and second areas of light and produces respective first and second signals in response thereto. The first and second signals uniquely correspond to positions of the first and second areas of light, respectively, on the surface of the light detecting element.

Processing circuitry within the housing is electrically coupled to one of the first and second portions of the optical transducer. Driving circuitry is electrically coupled to the other of the first and second portions of the optical transducer. The driving circuitry causes the first and second light emitting elements to emit light, and the processing circuitry (ii) receives the respective first and second signals, and produce a first position signal based on the first and second signals. The first position signal corresponds to an absolute position of the movable member with respect to the three degrees of freedom.

The present invention also embodies a method of computing positional coordinates of an elongated member movable along at least two of three mutually perpendicular axes and rotatable about at least a third axis that is perpendicular to the two axes. The method includes the steps of: (1) projecting light from a first light emitting element to a light detecting element following movement of the elongated member; (2) determining a first incident direction of light from the first light emitting element to the light detecting element; (3) projecting light from a second light emitting element to the light detecting element; (4) determining a second incident direction of light from the second light emitting element to the light detecting element; (5) determining a spatial position of the elongated member along the two of three mutually perpendicular axes about the one of the three axes based on the determined first and second incident directions of light from the respective first and second light emitting elements; (6) determining a rotational position of the elongated member about the one of the three axes based on the determined first and second incident directions of light from the respective first and second light emitting elements; and (7) outputting the spatial and rotational positions to a computer.

According to principles of the present invention, a user input device for inputting computer signals, such as a joystick, has an elongated member or handle that is movably received by a housing. The handle is capable of moving in at least three orthogonal directions, i.e., along X, Y and Z axes, and is capable of being rotated about at least one of the axes. In a first embodiment, a pair of light emitting diodes ("LEDs") are mounted at an end of the handle and oriented toward the interior of the housing. The LEDs are flashed or strobed to alternately project light downward into the housing. In a second embodiment, the LEDs are positioned within the housing and project the light upward. A light detecting element such as a two-dimensional position sensing device ("PSD"), two one-dimension PSDs, or a photodiode divided into four quadrants, is positioned opposite the LEDs, and receives the light from the LEDs to produce signals. The signals are converted from analog to digital and input to a microprocessor. The microprocessor, employing trigonometric methods, calculates the position and rotation of the handle and outputs the coordinates to a host computer. The joystick also preferably includes switches that produce switch signals and a slidable member that produces a variable signal. The switch signals and variable signal are also output to the host computer.

The digital signals output to the host computer represent the absolute position of the joystick. The digital signals are repeatedly transmitted to the host computer in the form of packets having a preselected format, each packet including position information, switch signals, position of the slidable member, etc. As a result, the joystick of the present invention provides standardized, digital signals that can be used in a variety of applications and with a variety of computers or other systems. The joystick of the present invention provides digitized position signals that correspond to the absolute position of the elongated member that do not fluctuate with temperature, humidity, etc., and that do not require calibration circuitry or routines. Other features and advantages of the present invention will become apparent from studying the following detailed description of the presently preferred embodiment, together with the following drawings.

BRIEF DESCRIPTION OF THE DRAWINGS

FIG. 14 is a graph showing a plot of a differential ratio of current output by the light detecting unit of FIG. 6 versus an incident angle of light in degrees.

FIG. 16 is an enlarged top plan view of the first alternative embodiment of the light detecting element of FIG. 7, with an X-Y coordinate system superimposed thereon.

FIG. 18A is a top schematic view of the light emitting elements of FIG. 4B representing rotation of the handle of the computer input device of FIG. 1.

FIG. 18B is a top schematic view of the light emitting elements of FIG. 5B representing a rotation of the handle of the computer input device of FIG. 1.

DETAILED DESCRIPTION OF THE PRESENTLY PREFERRED EMBODIMENT

The present invention provides a method and system of producing absolute position coordinates of a first member movable in at least three degrees of freedom with respect to a second member. The present invention employs an optical-type transducer capable of providing absolute position signals for up to six degrees of freedom of the movable member with respect to the stationary member. The present invention is generally described below for use in a joystick-type computer input device that provides position signals based on four degrees of freedom. However, those skilled in the art will recognize that the present invention can be readily adapted for use in various systems requiring absolute position signals to be generated for the position of a movable member movable in lesser or greater degrees of freedom.

Figure 1:
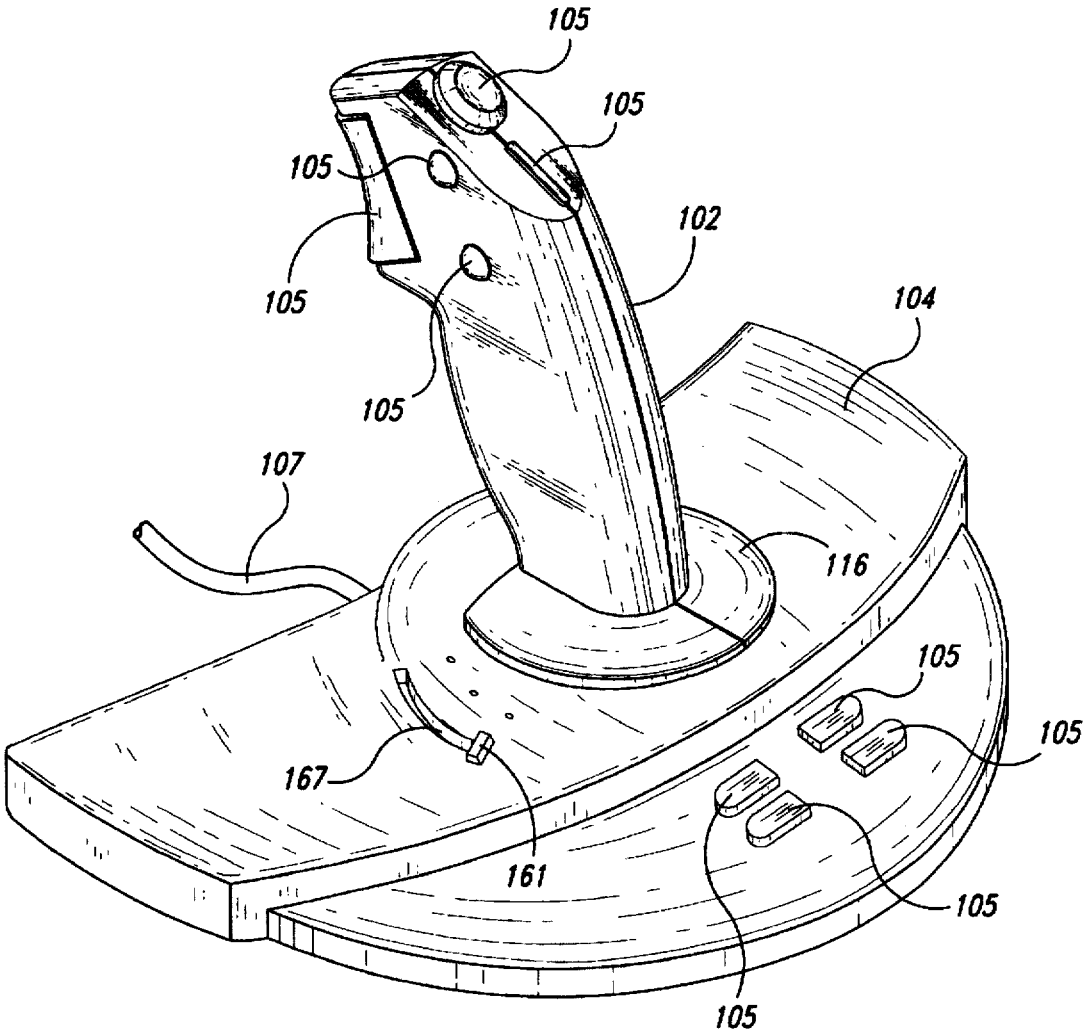
FIG. 1 is a rear isometric view of the computer input device embodying the system of the present invention.
Figure 2:
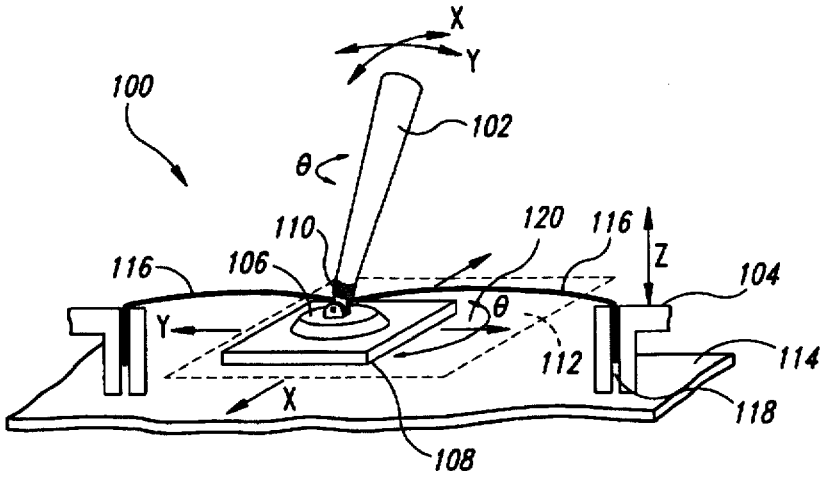
FIG. 2 is a partial isometric, partial schematic, cutaway view of the computer input device of FIG. 1.

Referring to FIG. 1, a computer input device 100 includes an elongated member or handle 102 movably retained by a housing 104. Both the handle 102 and housing 104 preferably have button switches 105 extending outward therefrom. An electrical cable 107 couples the input device 100 to external components such as a computer. As shown in FIG. 2, a center coupling 106 at the center of a plate 108 is pivotally retained at a first end 110 of the handle 102 within an interior portion 120 of the housing 104. The plate 108 is mechanically coupled at the first end of 110 of the handle 102 so that the plate moves preferably within or parallel to an operating plane 112. The operating plane 112 is preferably above and parallel to a base 114 of the housing 104. A vertically movable shield 116 slides within a slot 118 formed in the housing 104. The slidable shield 116 permits the handle 102 to move vertically while restricting ambient light or contaminants from entering into the interior portion 120 of the housing 104.

Figure 3A:
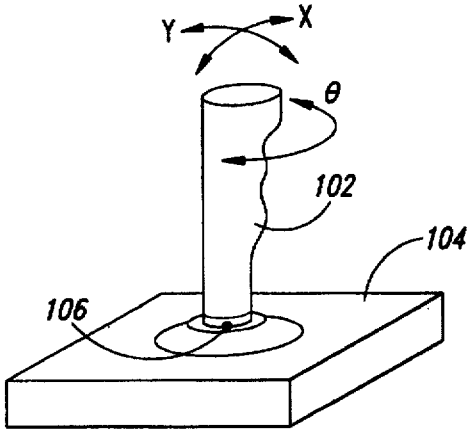
FIG. 3A is an isometric, schematic view of the computer input device of FIG. 1 showing three degrees of freedom of which the computer input device is capable.
Figure 3B:
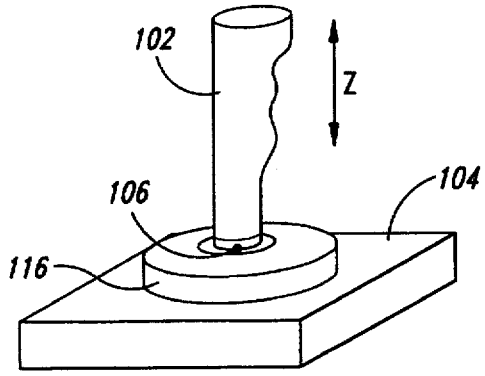
FIG. 3B is an isometric, schematic view of the computer input device of FIG. 1 showing a fourth degree of freedom of which the computer input device is capable.
Figure 3C:
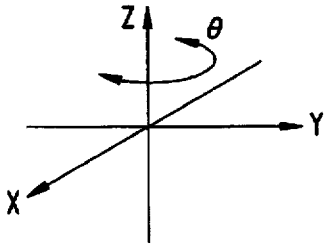
FIG. 3C is a three-dimensional, orthogonal coordinate axis system used to analyze position for the isometric figures herein.

As shown in FIGS. 3A, 3B and 3C, the handle 102 is movably retained by the housing 104 to permit horizontal pivotal movement within a plane defined by two perpendicular directions, i.e., along X and Y axes. In other words, the handle 102 is pivotally movable about the center coupling 106 with respect to the X-Y plane. Such pivotal movement of the handle 102 about the X and Y axes results in movement of the plate 108 parallel to the operating plane 112, which is parallel to the X-Y plane. Additionally, the plate 108 is capable of moving vertically along a Z axis in response to upward movement of the handle 102 and the center coupling 106, the Z axis being mutually perpendicular to the X and Y axes. As the handle 102 and the center coupling 106 move vertically, the plate 108 preferably maintains a parallel position with respect to the operating plane 112. Furthermore, the handle 102 is preferably rotatably retained by the housing 104 to permit rotational or torsional movement θ about the Z axis. Again, the plate 108 preferably maintains a parallel position with respect to the operating plane 112 as the handle 102 rotates about the Z axis.

Those skilled in the relevant art will recognize that the input device 100 can use any mechanical coupling with the handle 102 that permits the handle and plate 108 to move with the four degrees of freedom shown diagramatically in FIG. 3C, i.e., movement along X, Y and Z axis and rotation θ about the Z axis. Such mechanical coupling must convert pivotal movement of the handle 102 about the X and Y axes into corresponding but opposite planar movement of the plate 108 along the X and Y axes. Similarly, such mechanical coupling must also permit rotational movement θ about the Z axis and a vertical movement of the plate 108 along the Z axis with corresponding movement of the handle 102, in its entirety.

Figure 4A:
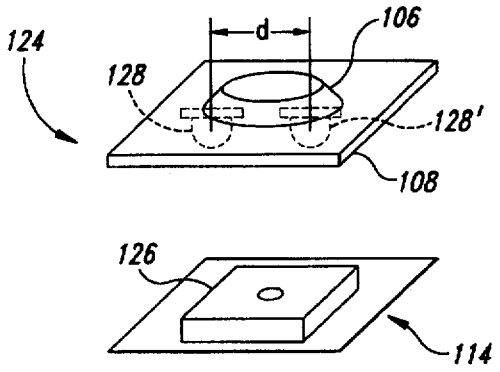
FIG. 4A is an isometric view of an optical transducer having light-emitting and light detecting elements used with the computer input device of FIG. 1.
Figure 4B:
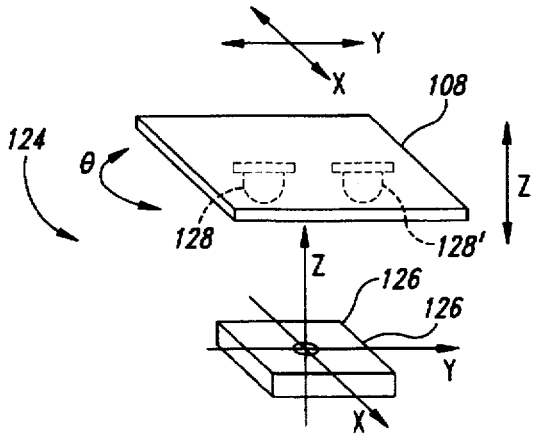
FIG. 4B shows the coordinate system of FIG. 3C and the illustrated four degrees of freedom of the computer input device of FIGS. 3A and 3B superimposed on the optical transducer system of FIG. 4A.

As shown in FIGS. 4A and 4B, an optical transducer 124 has a light detecting unit 126 and two light emitting elements, such as left and right light emitting diodes (LEDs)

128 and 128', respectively. The LEDs 128 and 128' are affixed to an underside of the plate 108 to project light downward toward the light detecting unit 126 that is affixed to the base 114. As described more fully below, movement of the handle 102 in the X-Y plane causes the plate 108 to move parallel to the operating plane 112 and causes light from the LEDs 128 and 128' to be received by the light detecting unit 126 from various angles as the plate is moved.

Figure 5A:
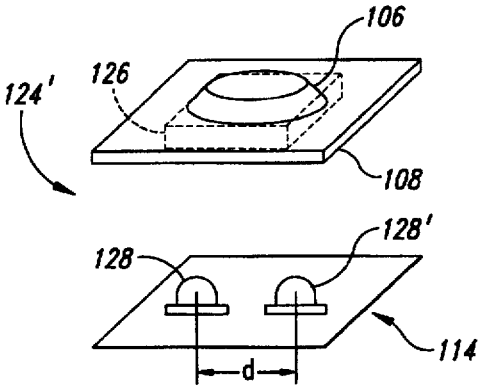
FIG. 5A is an isometric view of a first alternative embodiment of the optical transducer system of FIG. 4A.
Figure 5B:
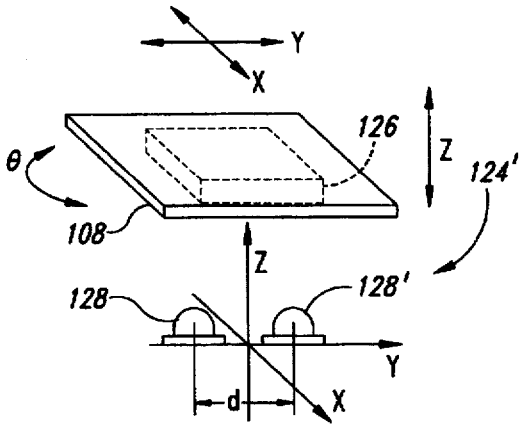
FIG. 5B shows the coordinate system of FIG. 3C and the illustrated four degrees of freedom of the computer input device of FIGS. 3A and 3B superimposed on the first alternative transducer of FIG. 5A.

In an alternative embodiment of the optical transducer 124, shown as optical transducer 124' in FIGS. 5A and 5B, the light detecting unit 126 is affixed to the underside of the plate 108, while the LEDs 128 and 128' are affixed to the base 114 and project light upward. Movement of the handle 102 in the X-Y plane causes the light detecting unit 126 to move parallel to the operating plane 112 and receive light from the LEDs 128 and 128' from differing angles. This and other alternative embodiments described below are substantially similar to the previously described embodiment, and common elements or steps are generally identified by the same number. Only the significant differences in construction or operation are described in detail. For example, the present invention is generally described with respect to the optical transducer 124 of FIGS. 4A and 4B. Significant differences in construction or operation between the optical transducer 124 and the optical transducer 124' of FIGS. 5A and 5B are described in detail below.

The light detecting unit 126 preferably consists of one of three embodiments each having a different light detecting element. In a first embodiment, shown in FIG. 6, the light detecting unit 126 consists of an apertured plate 130 spaced from a four quadrant photodiode 132 that acts as the light detecting element. The photodiode 132 is preferably a unitary device having a cruciform partition formed on its active surface that defines four quadrants A, B, C, and D of equal area. The center of the active surface of the photodiode 132 preferably defines the origin of the X, Y, Z coordinate system, as shown in FIG. 4B. As explained more fully below, each quadrant outputs a current signal proportional to the amount of light impinging on the quadrant. The apertured plate 130 is positioned a predetermined distance f away from the photodiode 132 and has a centrally formed aperture 134. The aperture 134 is positioned perpendicularly from, or in line with, the center of the four quadrants A, B, C, and D.

Figure 7:
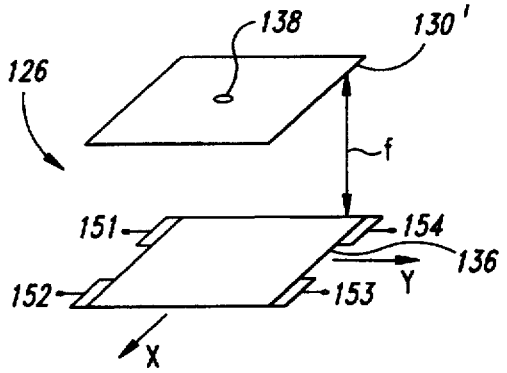
FIG. 7 is an isometric view of a first alternative embodiment of the light detecting unit of FIG. 6.

Referring to FIG. 7, a first alternative embodiment of the light detecting unit 126 consists of the apertured plate 130' positioned spaced apart from a two-dimensional position sensing device ("PSD") 136 acting as the light detecting element. The apertured plate 130' has a centrally located pinhole 138 that permits a small spot of light to impinge on the active upper surface of the PSD 136. The PSD 136 is a unitary device that outputs signals indicating the exact position of the impinging light spot, independent of the amount of impinging light. Those skilled in the relevant art may select from any PSDs currently available, such as those manufactured by Hamamatsu Corporation.

The apertured plate 130 or 130' is preferably parallel to the light detecting element. The apertured plate 130 or 130' can be either a plate of rigid material having the aperture 134 or pinhole 138 formed therethrough, or be a transparent or translucent material positioned over the photodiode 132 or PSD 136 that has an opaque coating on its outward surface which surrounds and defines the aperture or pinhole. The aperture 134 or pinhole 138 is preferably circular or square, but may have other shapes. Therefore, while the aperture 134 or pinhole 138 directs an approximately circularly shaped light spot onto the active surface of the photodiode 132 or PSD 136, as used herein, the terms "light spot" and "spot of light" refer to any shape of light impinging on the light detecting elements of the light detecting unit 126 described herein.

Regardless of the shape, the area of the light spot must be smaller than that of the active surface of the light detecting element. For the photodiode 132, the light spot is preferably equal to the area of one of the quadrants A, B, C, and D. Therefore, the aperture 134 preferably has an area approximately equal to the area of each of the four quadrants A, B, C and D. The aperture 134 is also preferably small enough so that no matter how far the LEDs 128 and 128' move with respect to the photodetector 132, the light spot never moves off of the active surface of the photodiode 132.

Figure 8:
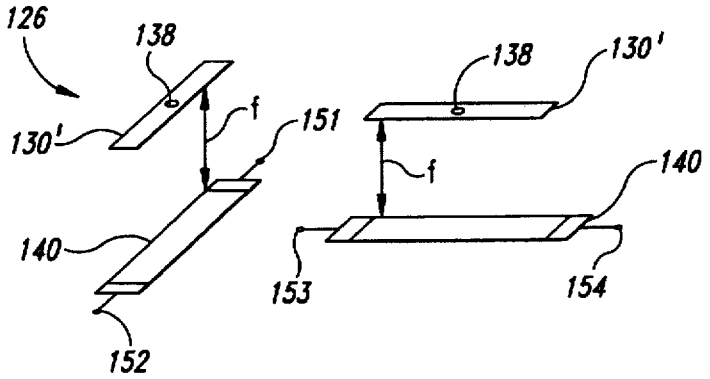
FIG. 8 is an isometric view of a second alternative embodiment of the light detecting unit of FIG. 6.

Referring to FIG. 8, a second alternative embodiment of the light detecting unit 126 consists of two apertured plates 130', each positioned spaced apart from a respective one of two one-dimensional PSDs 140. The one-dimensional PSDs 140 are arranged to be mutually perpendicular. The pinholes 138 in the apertured plates 130' are positioned the distance f away from, and in line with the center of its corresponding one-dimensional PSD 140. The two apertured plates 130' can have slits, instead of the pinholes 138, with the slits being positioned in the center of the apertured plates, and being oriented perpendicular to the length of the corresponding one-dimensional PSD 140. For the PSDs 136 and 140 of FIGS. 7 and 8, the light spot that impinges on the active surface of the PSD is preferably quite small to improve the signal to noise ratio ("S/N") of the signal output from the device, but is greater than pinhole size.

Those skilled in the relevant art will recognize based on the detailed description provided herein that other light detecting units can be employed that fulfill the operating principles that are described herein. Additionally, those skilled in the relevant art will recognize that other light emitting elements may be used, besides the LEDs 128 and 128'. The specific components employed by the optical transducer 124 may be selected by those skilled in the art based on design criteria or system optimization for a particular implementation.

For example, the PSD 136 of FIG. 7 can be tuned to provide a strongest signal at a peak wavelength of approximately 880 or 940 nm. Therefore, the LEDs 128 and 128' are preferably selected to provide a peak intensity of light at a wavelength of approximately 880 or 940 nm. An optical filter (not shown) of a band pass type can optionally be employed to pass light at the 880 or 940 nm wavelength therethrough.

Figure 6:
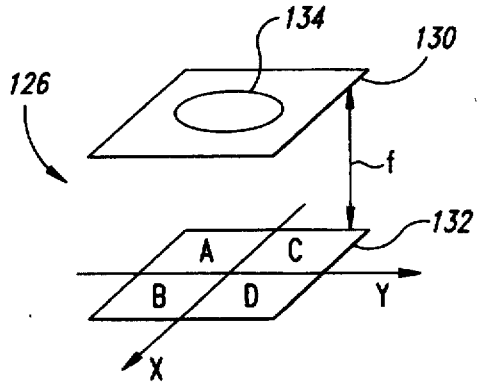
FIG. 6 shows is an enlarged isometric view of a light detecting unit that forms a portion of the optical transducer of FIGS. 4A and 5A.

Additionally, the housing 104 and slidable shield 116 preferably restrict ambient light from entering the interior portion 120 of the input device 100, and therefore, the housing and shield provide a closed unit that allows the photodiode 132 of FIG. 6 and PSDs 136 and 140 of FIGS. 7 and 8 to provide a large S/N. However, to further improve the S/N of the input device 100, additional optical components can be added to the optical transducer 124, as is known by those skilled in the art. For example, an optical filter (not shown), such as the band pass type noted above, can be placed over the aperture 134 or pinhole 138 to block ambient light, electromagnetic interference (EMI) and even particulate contamination from interfering with the light detecting unit 126. Additionally, or alternatively, a lens (not shown) can be secured over the apertured plate 130 or 130' to draw in more light from the LEDs 128 and 128' than without such a lens, and to focus such light onto the active surface of the photodiode 132, or PSDs 136 and 140.

Figure 9:
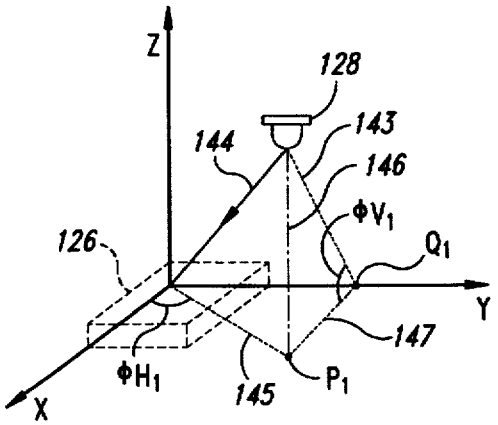
FIG. 9 is an isometric, schematic view showing an example of horizontal and vertical incident angles that define an incident ray of light from a single light emitting element from the optical transducer of FIGS. 4A and 5A.

As explained more fully below, the present invention determines four positions of the handle 102 along the three axes, X, Y and Z, and the rotation θ of the handle about the Z axis by first determining an incident direction of light from each of the LEDs 128 and 128', and then computing the four position coordinates of the handle 102. Referring to FIG. 9, the light from the left LED 128 incident on the light detecting unit 126 is represented by a line 144 defined by two angles: a horizontal angle $\phi H_1$ and a vertical angle $\phi V_1$. The following explanation is directed to the position of, and light from, the left LED 128; the same discussion applies to determining horizontal and vertical angles $H\phi_2$ and $V\phi_2$ for the right LED 128' as will be more fully discussed below with respect to FIGS. 17A and 17B.

The horizontal angle $\phi H_1$ is defined as the angle from the X-Z plane to a plane extending through the Z axis and perpendicular to the X-Y plane, which forms a line 145 in the X-Y plane running from the origin to a point $P_1$. The point $P_1$ is defined by a line 146 extending perpendicularly from the X-Y plane through the LED 128. A line 147 extends perpendicularly from the Y axis to the point $P_1$ to define a point $Q_1$ on the Y axis, while a line 143 extends from the left LED 128 to the point $Q_1$. The vertical angle $\phi V_1$ is defined as the angle from the X-Y plane to a plane extending through the Y axis and perpendicular to the X-Z plane that forms the line 143. FIG. 9 shows a four-sided pyramid formed by the origin, the left LED 128, and the points $P_1$ and $Q_1$.

Figure 10A:
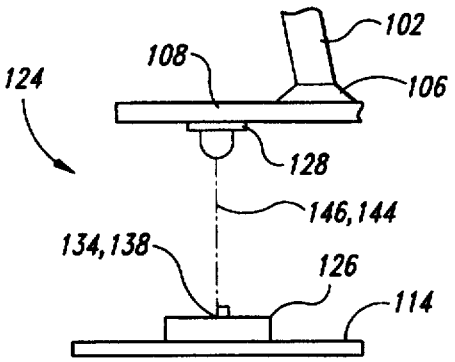
FIG. 10A is a side elevational view of a light emitting element and the light detecting unit from the optical transducers of FIGS. 4A, showing the light emitting element in a first position.
Figure 11A:
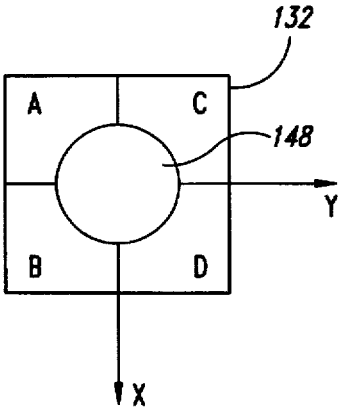
FIG. 11A is an enlarged top plan view of the light detecting unit of FIG. 6 showing an incident spot of light, from the light emitting element of FIG. 10A, in the first position.

How the present invention determines a position of the handle 102 based on the three above-described embodiments for the light-detecting unit will now be discussed. Referring to FIG. 10A, showing the first embodiment of the light detecting unit 126 employing the photodiode 132 (FIG. 6), the left LED 128 is directly over the center of the light detecting unit 126. The left LED 128 in FIG. 10A produces the incident light along the line 144, which is along the direction of the line 146, and produces a light spot 148 that is positioned at the center of the active surface of the photodiode 132, as shown in FIG. 11A. The photodiode 132 can be considered as if four adjacent photodiodes corresponding to quadrants A–D each output a signal whose amplitude varies proportionally to the amount of light incident on its active surface. As shown in FIG. 11A, the light spot 148 will be positioned in the middle of the photodiode 132 when the light from the LED 128 is directly over the center of the light detecting unit 126. All four quadrants A, B, C and D of the photodiode 132 receive an approximately equal amount of light from the light spot 148, and therefore, each output a substantially equal signal.

Figure 10B:
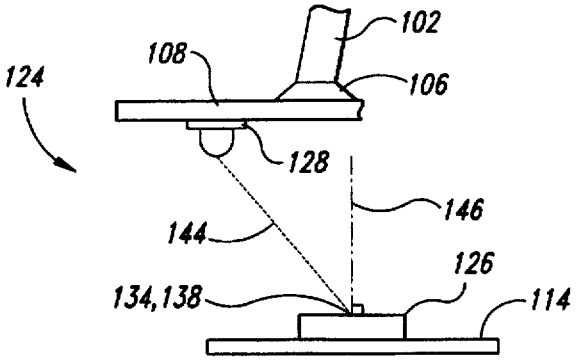
FIG. 10B is a side elevational view of a light emitting element and the light detecting unit of FIG. 10A showing the light emitting element in a second position.
Figure 11B:
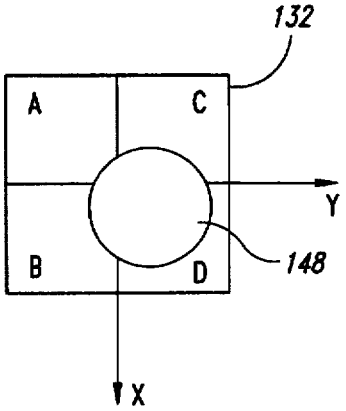
FIG. 11B is an enlarged top plan view of the light detecting unit of FIG. 6 showing an incident spot of light, from the light emitting element of FIG. 10B, in the second position.
Figure 13:
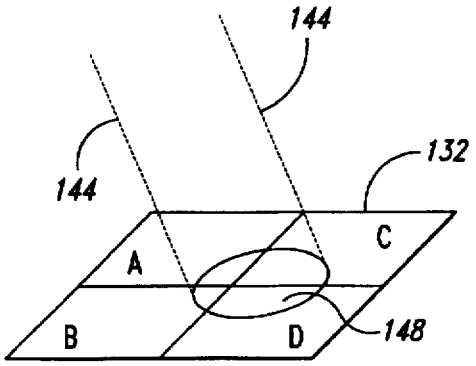
FIG. 13 is an enlarged isometric view of the light detecting unit of FIG. 6 receiving light from the light emitting element of FIG. 10B.

Referring to FIG. 10B, as a user moves the handle 102 rightward, the plate 108 and the LEDs 128 and 128' mounted thereon move leftward. The direction of the incident light along the line 144 through the aperture 134 travels from left to right to provide more light rightward of center on the active surface of the photodiode 132 as shown in FIG. 11B. Consequently, as shown in FIG. 11B, and isometrically in FIG. 13, the signals output from the leftmost quadrants A and B of the photodiode 132 have a lower amplitude than signals output from the rightmost quadrants C and D (i.e., (A+B)<(C+D)). As a result, the below-described circuitry analyses the current signals output from the quadrants A, B, C and D and determines that the handle 102 has moved rightward since the rightmost quadrants C and D output a stronger signal than the leftmost quadrants A and B of the photodiode 132.

FIG. 14 shows a graph of the incident direction of light (in degrees) from one of the LEDs 128 and 128' as it moves in the Y axis direction versus the ratio of output signals from the photodiode 132. As shown by the graph of FIG. 14, the output signal from the photodiode 132 is substantially linear with respect to movement of the light spot 148 on the photodiode. The photodiode 132 similarly has a linear output for movement of the light spot 148 along the X axis direction. The ratio in the graph of FIG. 14 was determined by the output difference between quadrants C and D, and A and B, which was normalized by the total output of all four quadrants, i.e., as represented by the following equation: [(C+D)–(A+B)]/(A+B+C+D). Therefore, the graph represents movement of the light spot 148 in the Y axis direction (see, e.g., FIG. 11A). The graph of FIG. 14 was produced from a photodiode 132 having an active surface of dimensions 2.0×2.0 mm, with a distance f of 1.0 mm between the surface of the photodiode and the aperture 134 in the apertured plate 130. The aperture 134 was circular, having a diameter of 2.0 mm. Preferably, the photodiode 132 has quadrants A–D that are 1.65 mm square, with a 0.01 mm gap between quadrants. With a circular aperture 134 having a diameter of 1.65 mm, a similarly linear graph as shown in FIG. 14 results from such a configuration.

Based on a slope of the line plotted in FIG. 14, an optical coefficient K can be determined that compensates for the size and shape of the aperture 134 and the distance between the aperture and the photodiode 132. The constant K, as determined from FIG. 14, is based on movement of the light spot 148 in the Y axis direction. Since the aperture 134 is circular, the same constant K applies to movement of the light spot 148 in the X axis direction. Since the output of the photodiode 132 has a substantially linear slope in response to movement of a light spot on its active surface, the position of the light spot can be accurately determined with the following equations:

$$X=\left[\frac{(B+D)-(A+C)}{A+B+C+D}\right]\cdot(K) \tag{1}$$

$$Y=\left[\frac{(C+D)-(A+B)}{A+B+C+D}\right]\cdot(K) \tag{2}$$

where X and Y are the respective X and Y axis position coordinates of the light spot 148 on the photodiode 132. Since the light spots move in corresponding relation to movement of the LEDs 128 and 128', and since the LEDs move in opposite, corresponding relation to movement of the handle 102, the photodiode 132 can provide a position signal of an X and Y axis position of the handle 102. Therefore, the photodiode 132, with sufficient accuracy, determines an X and Y position of the handle 102 based on pivotal movement of the handle 102 along the X and Y axes.

Based on trigonometry, and as explained more fully below with respect to FIGS. 17A and 17B, the horizontal and vertical angles $\phi H_{1,2}$ and $\phi V_{1,2}$ for the incident light from the LED's 128 and 128' are then determined from the following equations:

$$\phi H_{1,2}=\tan^{-1}(X/f) \tag{3}$$

$$\phi V_{1,2}=\tan^{-1}(Y/f) \tag{4}$$

where X and Y are determined from equations (1) and (2) (or (5) and (6) below) and f equals the perpendicular distance from the apertured plate 130 to the active surface of the photodiode 132.

Figure 12A:
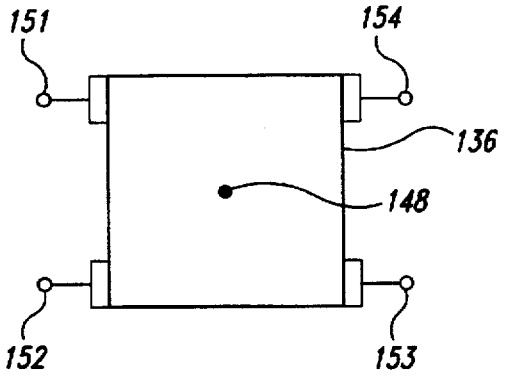
FIG. 12A is an enlarged top plan view of the light detecting unit of FIG. 7 showing an incident spot of light, from the light emitting element of FIG. 10A, in the first position.
Figure 12B:
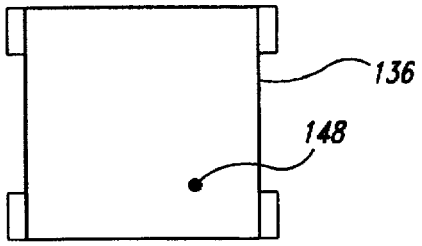
FIG. 12B is an enlarged top plan view of the light detecting unit of FIG. 7 showing an incident spot of light, from the light emitting element of FIG. 10B, in the second position.
Figure 15:
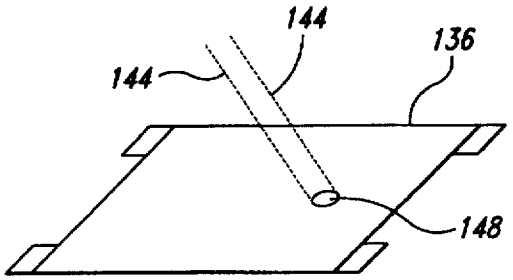
FIG. 15 is an enlarged isometric view of the light detecting unit of FIG. 7 receiving light from the light emitting element of FIG. 10B.

Referring to the second embodiment of the light-detecting unit 126 (FIG. 7), as shown in FIGS. 12A and 12B, and isometrically in FIG. 15, the light spot 148 moves on the active surface of the two-dimensional PSD 136 in a manner similar to that shown and described above with respect to FIGS. 11A, 11B, and 13 for the photodiode 132. Based on the position of the light spot 148, the below-described circuitry can compute the horizontal and vertical angles $\phi H_{1,2}$ and $\phi V_{1,2}$ that define the incident light along line 144.

An example of the two-dimensional PSD 136 is shown in FIG. 16 and has four terminals 151, 152, 153 and 154 that output respective voltage or current signals I1, I2, I3 and I4. The light spot 148 impinges on the active surface of the two-dimensional PSD 136 at a point having the X and Y position coordinates X and Y. The coordinates of the spot 148 along the X and Y axes on the two-dimensional PSD 136 are computed by the following equations:

$$X = \frac{(I3+I4)-(I1+I2)}{IO} \cdot (Lx/2) \quad (5)$$

$$Y = \frac{(I1+I4)-(I2+I3)}{IO} \cdot (Ly/2) \quad (6)$$

where IO equals the sum of the current output from the four terminals 151, 152, 153 and 154 (i.e., IO equals I1+I2+I3+I4). Lx equals the length of the active surface of the two-dimensional PSD 136 in the X axis direction and Ly equal the length of the active surface in the Y axis direction. If the two-dimensional PSD 136 has a square active area, then Lx=Ly=L. The horizontal and vertical angles $\phi H_{1,2}$ and $\phi V_{1,2}$ are then determined from equations (3) and (4) above (with f equaling the distance from the plate 130 to the active surface of the two-dimensional PSD 136).

Referring to the third embodiment of the light-detecting unit 126 which employs two one-dimensional PSDs 140, the horizontal and vertical angles $\phi H_{1,2}$ and $\phi V_{1,2}$ are determined in a substantially similar manner to that described above with respect to the two-dimensional PSD 136. The two one-dimensional PSDs 140 each have two terminals, and the two PSDs together supply the four current signals I1 through I4. The current signals I1 through I4 are then input into equations (5) and (6) above. Since the two one-dimensional PSDs 140 are positioned 90° from each other, only one of the one-dimensional PSDs can be positioned at the origin of the X, Y and Z axes, while the other one-dimensional PSD is positioned at an offset therefrom. Therefore, a constant value appropriate for the offset is included in equations (5) and (6) to compensate for the offset of the other one-dimensional PSD 140.

Figure 17A:
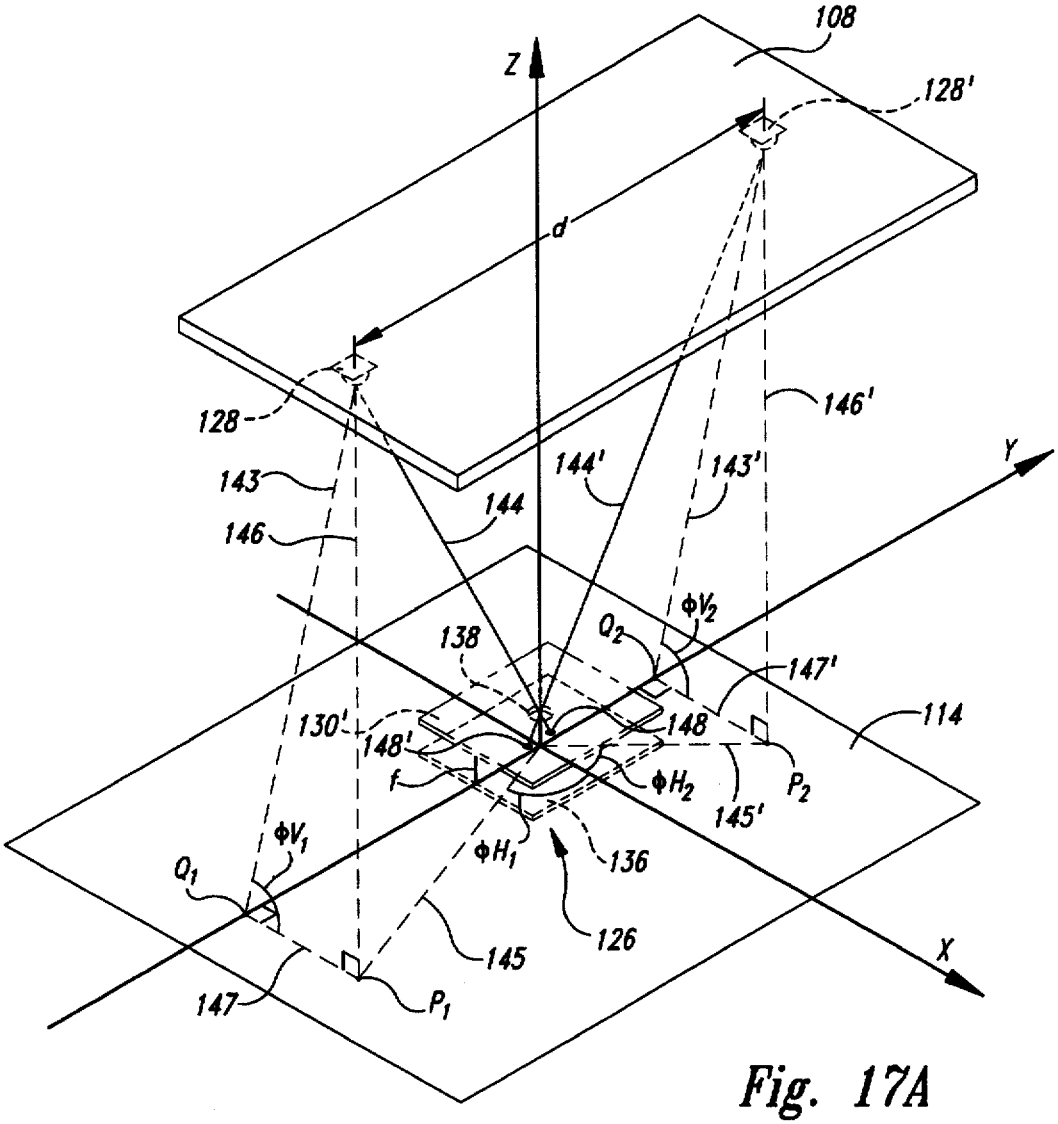
FIG. 17A is an isometric, schematic view of the optical transducer of FIG. 4B.
Figure 17B:
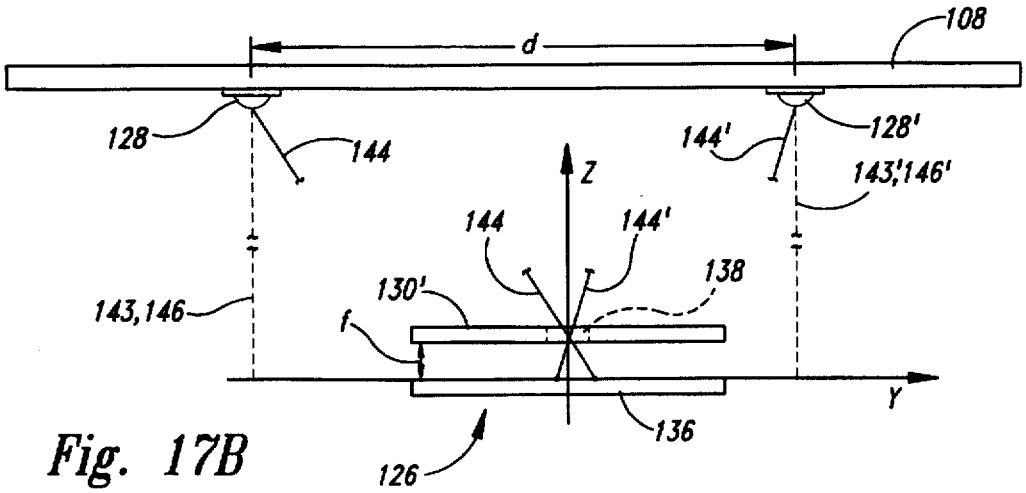
FIG. 17B is a side view of the optical transducer shown in FIG. 17A.

Referring to FIGS. 17A and 17B, equations necessary for calculating the X, Y and Z axis coordinates of the handle 102 will be described. For both of the optical transducers 124 and 124', the LEDs 128 and 128' are positioned at a distance d apart from each other. The left LED 128 projects the incident light that produces the light spot 148. The line 144 for the incident light is defined by horizontal and vertical angles $\phi H_1$ and $\phi V_1$. Similarly, light from the right LED 128' incident on the light detailing unit 126, is represented by a line 144' and produces a light spot 148'. The incident light along the line 144' is defined by horizontal and vertical angles $\phi H_2$ and $\phi V_2$. Using circuitry described below, the LEDs 128 and 128' are alternately strobed so that the LEDs never simultaneously provide light. As a result, the horizontal and vertical angles $\phi H_{1,2}$ and $\phi V_{1,2}$ can be determined separately for each LED 128 and 128'.

As shown more clearly in FIG. 17A, the LEDs 128 and 128' produce respective light spots 148 and 148' on the active surface of the light detecting unit 126 (for example, the two-dimensional PSD 136 shown in FIGS. 17A and 17B). The LED 128 produces the light along line 146 that strikes the plane of the base 114 at a point $P_1$. As described before with respect to FIG. 9, the line 147 extends perpendicularly from the Y axis at a point $Q_1$ to the point $P_1$, while the line 145 extends from the origin to the point $P_1$. A horizontal right triangle is formed thereby, with the line 145 being its hypotenuse. Similarly, a vertical right triangle is formed by the line 146, the line 147, and the line 143 that extends from the LED 128 to the point $Q_1$. The LED 128' similarly forms a horizontal right triangle formed by the Y axis from a point $Q_2$ to the origin, a line 147' extending perpendicularly from the point $Q_2$ to a point $P_2$, and a line 145'. Likewise, a vertical triangle is formed by a line 146', a line 143' and the line 147'.

As explained above, the plate 108 is slidably coupled to the housing 104 so that it remains parallel to the operating plane 112 (FIG. 2). Since the LEDs 128 and 128' are affixed to the underside of the plate 108 for the optical transducer 124 of FIGS. 4A and 4B, the LEDs always share the same Z axis position. Similarly, in the optical transducer 124' of FIGS. 5A and 5B, the light detecting unit 126 (i.e., the photodiode 132 or PSDs 136 or 140), is affixed to the underside of the plate 108 so the light detector unit always has the same Z axis position. As a result, using geometry and trigonometric functions, the present invention can determine X and Y axis position coordinates for the LEDs 128 and 128' as follows:

$$Px_1 = Z \cdot \tan(\phi H_1),\ Py_1 = Z \cdot \tan(\phi V_1) \quad (7)$$

$$Px_2 = Z \cdot \tan(\phi H_2),\ Py_2 = Z \cdot \tan(\phi V_2) \quad (8)$$

where $(Px_1, Py_1)$ are the respective X and Y axis coordinates of the LED 128 and $(Px_2, Py_2)$ are the respective X and Y axis coordinates of the LED 128'. Since the distance between the LEDs 128 and 128' is established as the predetermined value d, then the following Pythagorean expression is true:

$$(Px_2-Px_1)^2+(Py_2-Py_1)^2=d^2 \quad (9)$$

Additionally, since the origin of the X-Y-Z axis coordinate system is established at the center of the light detecting unit 126, and the LEDs 128 and 128' are always defined as being positioned above the origin, then the Z axis coordinates of the LEDs are always positive. Therefore, when equations (7) and (8) above are substituted into the equation (9), the following equations result:

$$z^2\{[\tan(\phi H_2)-\tan(\phi H_1)]^2+[\tan(\phi V_2)-\tan(\phi V_1)]^2\}=d^2, \quad (10)$$

thus, $$z = \frac{d}{\sqrt{[\tan(\phi H_2)-\tan(\phi H_1)]^2+[\tan(\phi V_2)-\tan(\phi V_1)]^2}}$$

The present invention can therefore calculate the Z axis coordinates of the LEDs 128 and 128' based on the horizontal and vertical angles $\phi H_{1,2}$ and $\phi V_{1,2}$ of the LEDs that were computed above from equations (3) and (4).

Figure 19:
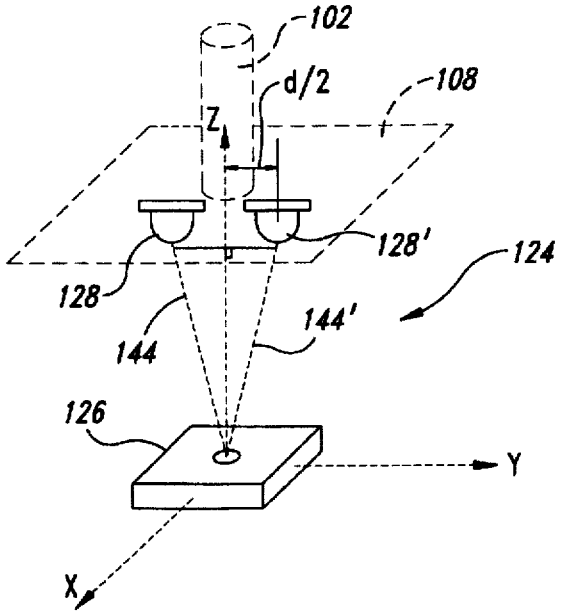
FIG. 19 is an isometric, schematic view of the optical transducer of FIG. 4B.

The LEDs 128 and 128' are preferably centered over the origin of the X, Y and Z axis, as shown in FIG. 19, when the handle 102, linked to the plate 108, is in its neutral position, aligned coaxial with the Z axis and therefore the LEDs are centered over the light detecting unit 126. As a result, the distance halfway between the LEDs is directly over the origin (i.e., d/2). Assuming that the LEDs 128 and 128' are centered over the origin, then the average of the X and Y axis position coordinates for the LEDs 128 and 128' provide the spatial position of the plate 108 with respect to the X, Y and Z axes. Consequently, since the handle 102 is linked to the plate 108 by the center coupling 106, the X, Y and Z axis position coordinates of the handle are determined by the following equation:

$$[(Px_1+Px_2)/2,\ (Py_1+Py_2)/2,\ z] \tag{11}$$

The calculation of the X, Y and Z axis position coordinates of the handle 102 are essentially identical (except as explained below) regardless of whether the LEDs 128 and 128' are mounted on the plate 108 and the light detecting unit 126 is located at the origin for the optical transducer 124, or vice versa for the optical transducer 124' of FIGS. 5A and 5B. Determining the angle of rotation θ of the handle 102, however, differs depending upon whether the optical transducer 124 or 124' is employed. Although the ultimate expression for determining the angle of rotation θ of the handle 102 is identical for both embodiments of the optical transducer 124 and 124', the intermediate equations to derive the ultimate expression differ.

As shown in FIG. 18A, when the LEDs 128 and 128' are affixed to the underside of the plate 108 as in the optical transducer 124' of FIGS. 4A and 4B, the LEDs rotate about a midpoint approximately half-way between the LEDs (i.e., at d/2). Alternatively, as shown in FIG. 18B for the optical transducer 124' of FIGS. 5A and 5B, when the LEDs 128 and 128' are affixed to the base 114 in the optical transducer 124', while the light detecting unit 126 is affixed to the underside of the plate 108, the light detecting unit rotates with the handle 102. As a result, the light from the LEDs 128 and 128' in the optical transducer 124', as detected by the light detecting unit 126, appear to pivot as a unit about a point collinear with, but not between, the LEDs.

Referring to FIG. 18A, the light detecting unit 126 in the optical transducer 124 is located at the origin of the X-Y-Z coordinate system and the plate 108 is assumed to be at a fixed distance spaced therefrom along the Z axis. As a result, the Z axis position coordinates are irrelevant for determining the angle of rotation θ. The below described circuitry preferably strobes the LEDs 128 and 128', and samples the signals produced by the light detecting unit 126, at a sufficiently high rate that the Z axis position does not change significantly under normal operation of the input device 100 by a user.

The LEDs 128 and 128' in the optical transducer 124 rotate about the midpoint that has X and Y axis coordinates of (Cx, Cy). Before rotation, the LEDs 128 and 128' have respective position coordinates L1' and L2', where L1' equals the position coordinates ($Px_1'$, $Py_1'$) and L2' equals the position coordinates ($Px_2'$, $Py_2'$). After rotation of the handle 102 by the angle θ, the LEDs 128 and 128' have respective position coordinates L1 and L2, where L1 equals the position coordinates ($Px_1$, $Py_1$) and L2 equals the position coordinates ($Px_2$, $Py_2$). Since the distance between the LEDs 128 and 128' equals the known distance d, and the position coordinates half-way between the LEDs is (Cx, Cy), the positions L1' and L2' are determined as follows:

$$L1'\text{: } (Px_1',\ Py_1')=(Cx+d/2,\ Cy),\ \text{and}$$

$$L2'\text{: } (Px_2',\ Py_2')=(Cx-d/2,\ Cy).$$

Since the angle of rotation between the positions of the LEDs 128 and 128' (i.e., from L1' to L1 and L2' to L2) is equal to the angle of rotation θ, the following equations result:

$$L1\text{: } (Px_1,\ Py_1)=[Cx+(d/2)\cos\theta,\ Cy+(d/2)\sin\theta],$$

$$L2\text{: } (Px_2,\ Py_2)=[Cx-(d/2)\cos\theta,\ Cy-(d/2)\sin\theta].$$

Therefore, the following equations result for calculating the angle of rotation θ of the handle 102:

$$\frac{Py_1-Py_2}{Px_1-Px_2}=\frac{d\cdot\sin\theta}{d\cdot\cos\theta}=\tan\theta,\ \text{thus,} \tag{12}$$

$$\theta=\tan^{-1}\left(\frac{Py_1-Py_2}{Px_1-Px_2}\right)$$

Referring to FIG. 18B, the LEDs 128 and 128' in the optical transducer 124' are affixed to the base 114. The LEDs have the same initial coordinates L1' and L2' before rotation, and the same coordinates of L1 and L2 after rotation by an angle θ. As shown in FIG. 18B, the LEDs 128 and 128' appear to rotate with respect to the light detecting unit 126 in a counterclockwise direction through the angle θ. Therefore, using the known equations for rotation of axes, the following expressions result:

$$Px_1=Px_1'\cos\theta+Py_1'\sin\theta;$$

$$Py_1=-Px_1'\sin\theta+Py_1'\cos\theta;$$

$$Px_2=Px_2'\cos\theta+Py_2'\sin\theta;\ \text{and}$$

$$Py_2=-Px_2'\sin\theta+Py_2'\ \text{cost}\ \theta.$$

When the LEDs 128 and 128' are at their initial positions L1' and L2', respectively, the Y axis coordinates of both of the LEDs are equal, as shown in FIG. 18B (i.e., $Py_1'=Py_2'$). Therefore, the following equations result:

$$Px_1-Px_2=Px_1'\cos\theta-Px_2\cos\theta;\ \text{and}$$

$$Py_1-Py_2=-Px_1'\sin\theta+Px_2'\sin\theta.$$

Consequently, solving for θ results in the following equations:

$$\frac{Py_1-Py_2}{Px_1-Px_2}=\frac{-(Px'_1-Px'_2)\cdot\sin\theta}{(Px'_1-Px'_2)\cdot\cos\theta}=-\tan\theta,\ \text{thus,} \tag{13}$$

$$-\theta=\tan^{-1}\left(\frac{Py_1-Py_2}{Px_1-Px_2}\right)$$

Since the light detecting unit 126, which defines the coordinate system, rotate instead of the LEDs 128 and 128', the angle of rotation θ has a negative value.

As explained above, the present invention calculates the four position coordinates of the handle 102, i.e., the X, Y and Z axis position and rotation angle θ about the Z axis, by using only two LEDs and the above equations. The two LEDs 128 and 128' are located in a common plane, either on the underside of the plate 108, or on the base 114 of the housing 104. The present invention can determine the absolute, as opposed to relative, position coordinates of the handle 102 when using either of the optical transducers 124 or 124'. In other words, the present invention provides unique position signals that correspond to the position of the handle 102. Assuming the LEDs 128 and 128' are strobed at a high rate and the above calculations are made rapidly enough, the four coordinates of the handle 102 can be calculated with great accuracy, constrained primarily by physical limitations of the optical transducer 124 or 124'. Calibrations can be made to the present invention to provide more accurate position coordinates based on the detailed description provided herein as applied to one of the co-inventor's earlier invention described in U.S. patent application Ser. No. 195,320, filed Feb. 14, 1994, entitled "Optical-Type Position and Posture Detecting Device."

Figure 20:
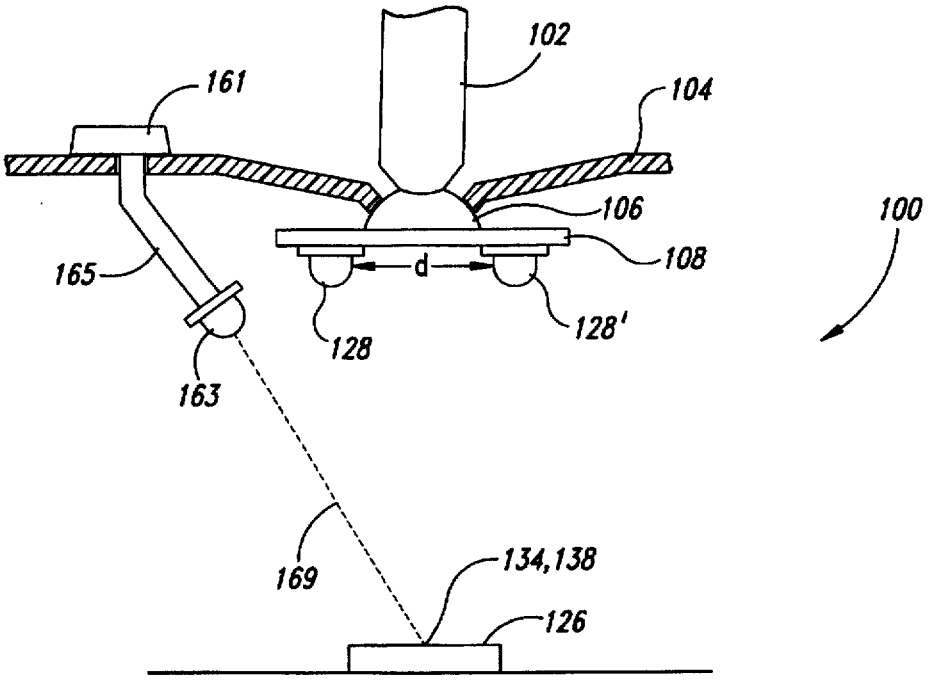
FIG. 20 is a schematic, partial cutaway view of the computer input device of FIG. 1 showing a slidable member for providing a variable signal input.

Referring to FIG. 20, the input device 100 of the present invention preferably provides signals in addition to the position coordinate signals. For example, the input device 100 preferably provides a variable signal capable of providing a series of unique values, such as voltage signals generated by a potentiometer in a conventional analog joystick. Therefore, as shown in FIG. 20, a throttle or manually slidable member 161 has a LED 163 secured thereto by means of an elongated support 165. The slidable member 161 is slidably received within a slot 167 formed in an upper surface of the housing 104 (FIG. 1). The LED 163 provides a light that travels along a line 169, which is received by the light detecting unit 126. The LED 163 is strobed in sequence with the LEDs 128 and 128' so that none of the LEDs provide light simultaneously with another LED.

Light generated by the LED 163 travels along the line 169 and produces the light spot 148 on the light detecting element in the light detecting unit 126. The below-described circuitry preferably analyzes the output signals from only two of the four quadrants in the photodiode 132, or from two of the four terminals in the PSDs 136 and 140. Therefore, if the light spot 148 produced by the LED 163 moves primarily along the X axis direction, then equation (1) or (5) is employed to determine the position of the LED. Since the light spot 148 moves in a direction opposite to movement of the slidable member 161, the inverse of the computed position signal may be required. Overall, as the light spot 148 moves about the active surface of the light detecting element in the light detecting unit 126, a variable signal is output therefrom.

Figure 21:
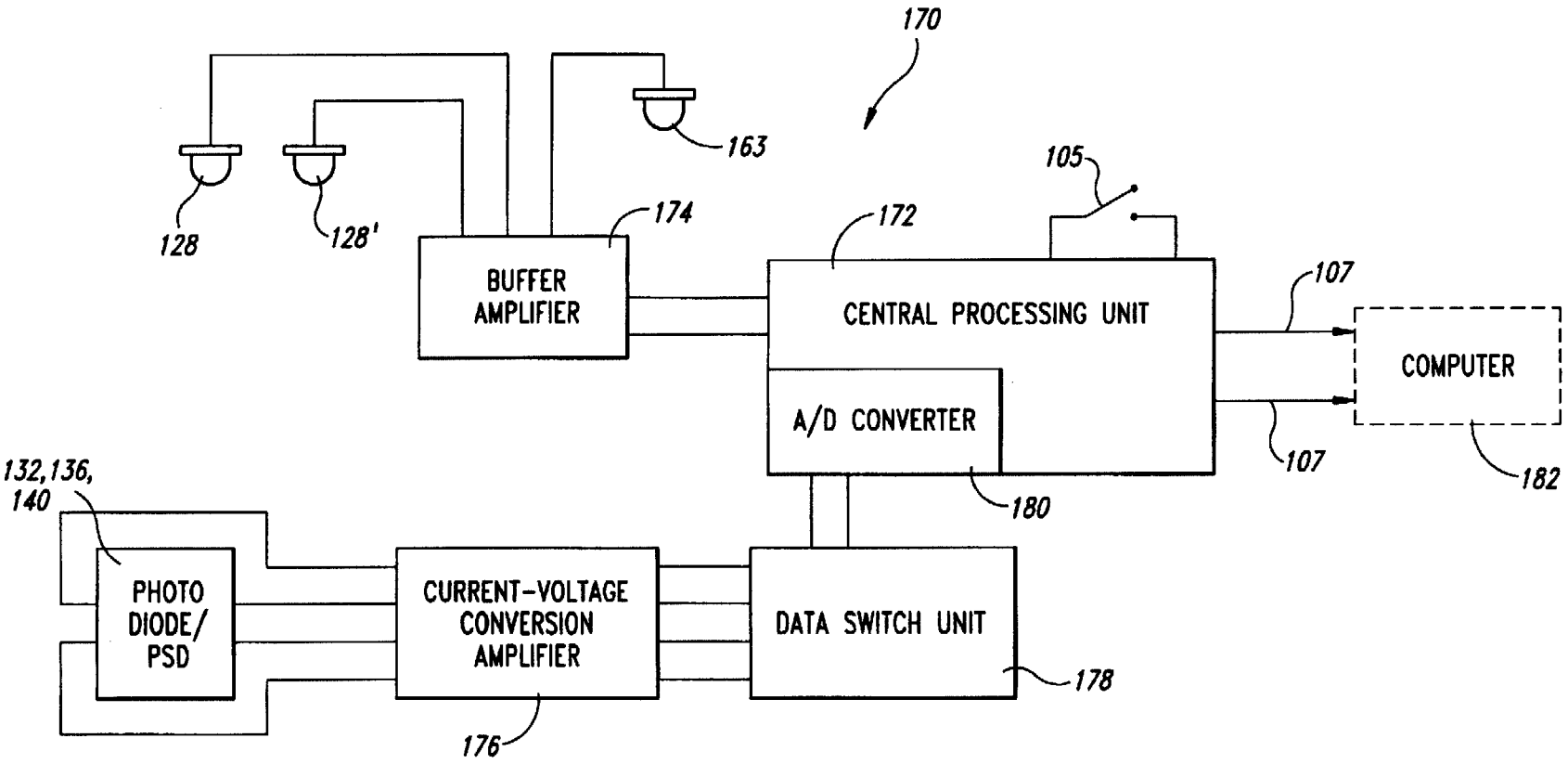
FIG. 21 is a block diagram of exemplary circuitry for use with the optical transducers of FIGS. 4B and 5B.

Referring to FIG. 21, an exemplary circuit 170 is shown for calculating the four position coordinates of the handle 102 and includes a central processing unit ("CPU") 172 that alternately strobes the LEDs 128, 128' and 163 via a buffer amplifier 174. The photodiode 132 or PSDs 136 or 140 are coupled to a current-to-voltage conversion amplifier 176 that converts the current-based signals from the photodiode/PSD into voltage-based signals. The photodiode 132 or PSDs 136 or 140 can include amplifiers, that amplify the current signals to improve the S/N of the circuit 170, if required. The photodiode 132 or PSDs 136 or 140 can also include on-chip calculation circuitry that performs initial position calculations of the signals output therefrom based on the initial equations set forth above, to thereby reduce demands on the CPU 172. Additionally, a low-pass or band-pass filter can be employed preceding or succeeding the current-to-voltage conversion amplifier 176 to eliminate EMI and further improve the S/N of the circuit 170.

Figure 22:
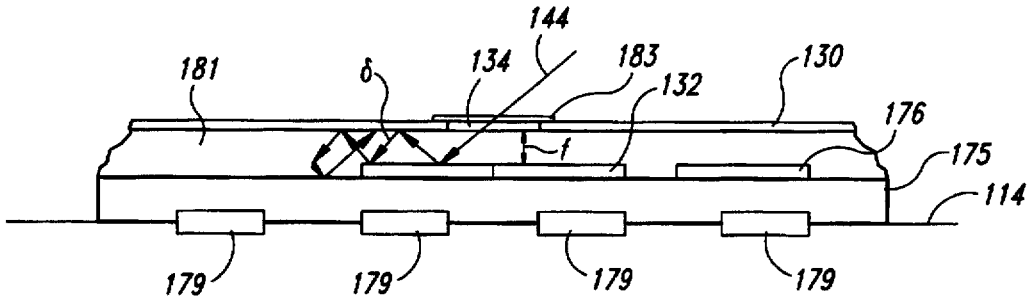
FIG. 22 is an enlarged side elevational view of an alternative embodiment of the light detecting unit of FIG. 6.

For example, as shown in FIG. 22, the photodiode 132 can be monolithically integrated on a single chip 175 with circuitry that forms the current-to-voltage conversion amplifier 176, and possibly other components such as the amplifiers, calculation circuitry or filters. The chip 175 includes electrical connection leads 179 that couple to the CPU 172 and other circuitry in the circuit 170.

For ease in manufacturing, a layer of plastic 181 can be formed over the chip 175 and photodiode 132 as shown in FIG. 22. The apertured plate 130 can then be formed as a layer of opaque material, such as aluminum formed by aluminum spattering on an upper surface of the plastic layer 181. A mask can be used prior to aluminum spattering to form the aperture 134. By being electrically conductive, the aluminum apertured plate 130 can be grounded to prevent EMI and improve the S/N of the circuit 170.

Figure 23:
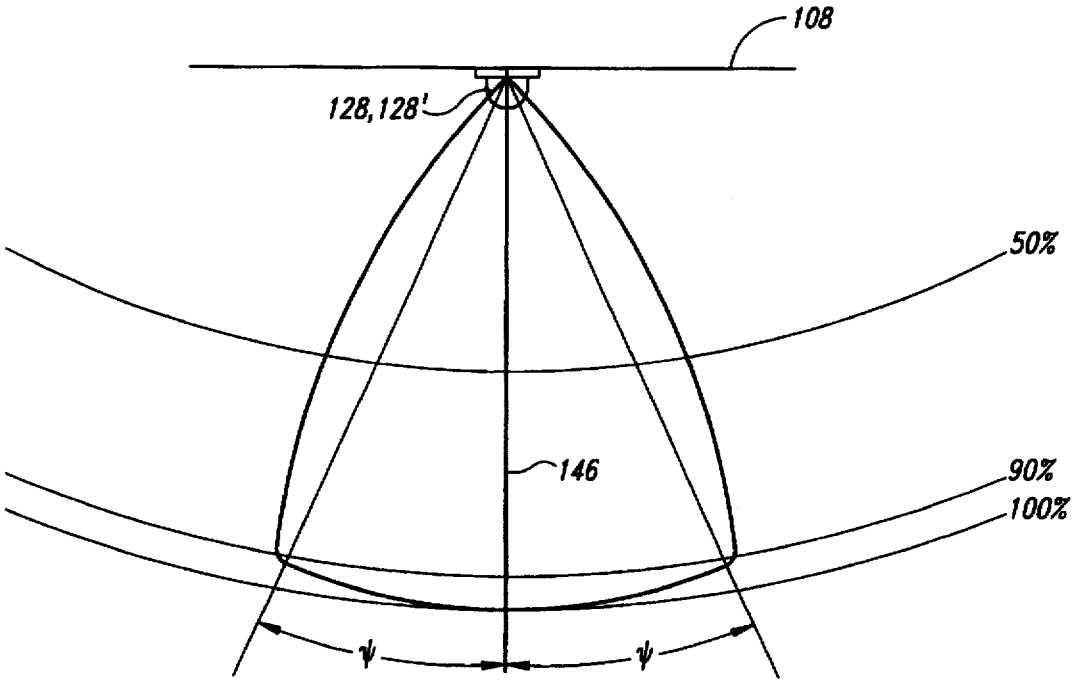
FIG. 23 is a side view of the light emitting element of FIG. 9 showing exemplary light intensity and beam angle for the light emitting element.

To further improve the S/N of the circuit 170, an anti-reflective coating 183 can be applied over the aperture 134, on the plastic layer 181, to promote light transmission to the photodiode 132, including the incident light along line 144. The distance f from the aperture to the active surface of the photodiode 132 should be selected to prevent complex reflections δ from providing erroneous light to the photodiode 132. Additionally, the LEDs 128 and 128' are preferably selected so that they direct and focus the light to the photodiode 132. As shown in FIG. 23, the LEDs 128 and 128' preferably have a power distribution that is focused along the line 146 perpendicular to the active surface of the photodiode 132. The LEDs 128 and 128' preferably have a beam angle ψ from the perpendicular line 146 that is sufficient to provide a light spot 148 with a constant intensity to the photodiode 132, even at a limit of a range of motion of the handle 102. For example, if the handle can pivotally move approximately +/−20 degrees in the X and Y axis directions from the Z axis, then the beam angle W is preferably equal to approximately 20 degrees. Additionally, the LEDs 128 and 128' preferably provide a constant light intensity over the beam angle ψ of approximately 90% beam intensity. An exemplary LED that provides such output characteristics is part BR1101W by Stanley Corporation. Selection of the LEDs 128 and 128', based on their beam angle ψ must take into account an index of refraction of the plastic cover 181 on the chip 175 that may require the beam angle to be increased.

Referring again to FIG. 21, the circuit 170 further includes a multiplexer or data switch unit 178 that receives the signals from the current-to-voltage conversion amplifier 176 and provides the signals to an analog-to-digital (A/D) converter 180. The data switch unit 178 switches the signals from the current-to-voltage conversion amplifier 176 in synchronism with the strobing of the LEDs 128, 128' and 163. The A/D converter 180 is preferably monolithically integrated with the CPU 172, but can be a separate component. The A/D converter 180 preferably has a sufficiently high conversion rate (e.g., 6–8 microseconds) and can employ oversampling to increase resolution of the circuit 170. The A/D converter 180 converts the inputted analog signals into digital signals that are processed by the CPU 172.

The CPU 172 is preferably of a microcontroller type, having on-chip memory (both ROM and RAM). The CPU 172 operates on the digitized signal, using the above equations, to produce the four position coordinates of the handle 102 and the variable signal based on the position of slidable member 161. The position coordinates and variable signals are then output to a computer 182 or other application or device over the electrical cable 107. The button switches 105 are coupled to the CPU 172 and provide switch signals which the CPU in turn provides to the computer 182. The circuit 170 can include a conversion circuit such as a programmable resistor to provide output signals suitable for a particular application.

Figure 24:
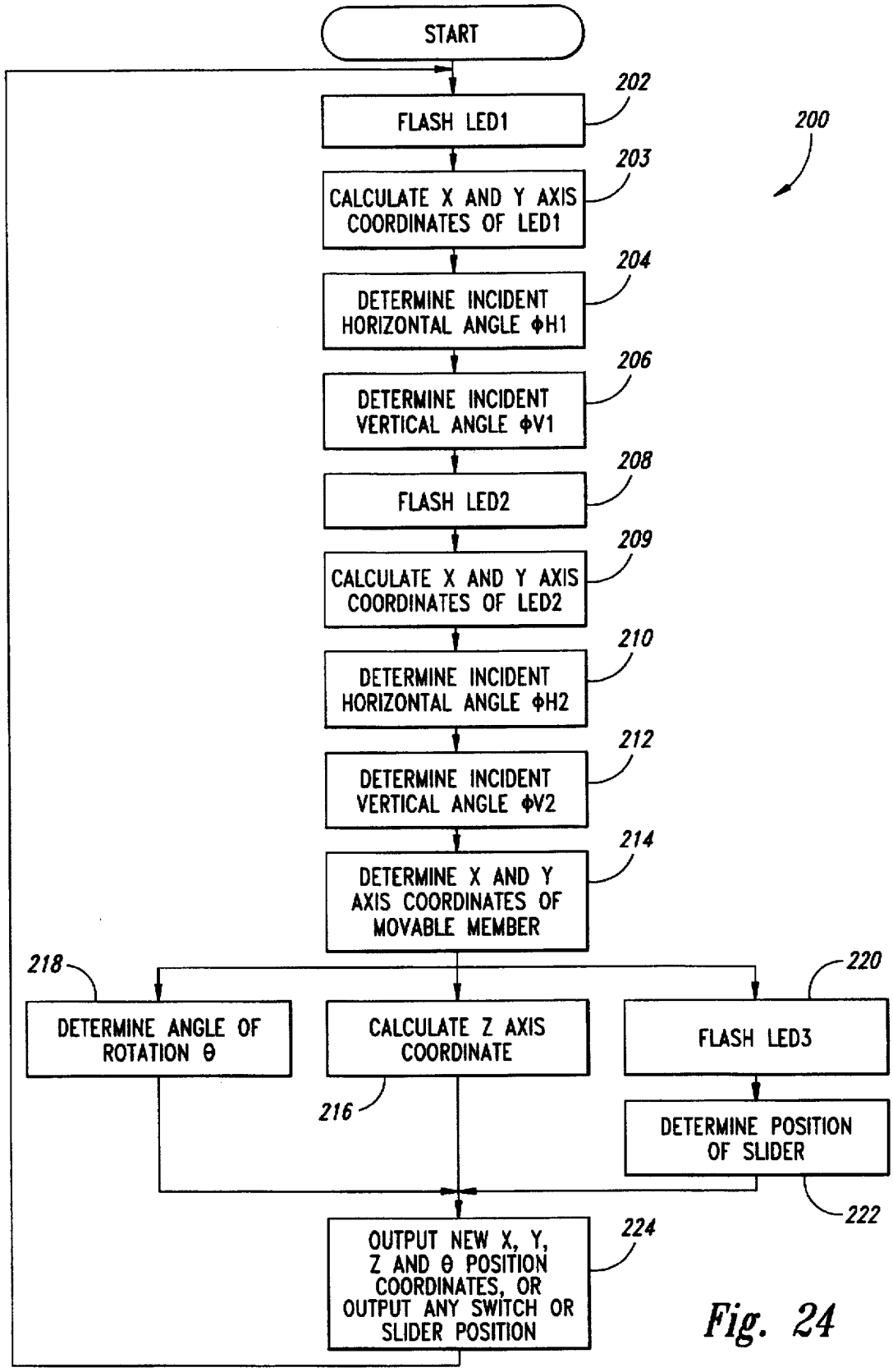
FIG. 24 is a flow chart showing the steps performed by the circuitry of FIG. 21.

One example of a suitable sampling and calculation method 200 according to the present invention is shown in FIG. 24. FIG. 24 is a high-level representation of the method performed under the present invention, and actual implementation on a specific CPU will require customization which should be apparent to those skilled in the relevant art. For example, such customization will likely require compensation for delays inherent in performing the steps of the method, while still maintaining acceptable resolution and accuracy.

The method 200, performed by the CPU 172, begins in step 202 by providing an appropriate signal to "LED1" or the left LED 128 causing it to emit light. In step 203, the CPU 172 calculates the X and Y axis position coordinates of the light spot 148 based on equations (1) and (2), or (5) and (6), and therefrom, calculates the X and Y axis position coordinates of the LED 128 based on equation (7). In step 204, the CPU 172 receives the signals produced from the photodiode 132 or PSD 136 or 140 and determines the horizontal angle $\phi H1$ based on equation (3). In step 206, the CPU 172 determines the incident vertical angle $\phi V1$ based on equation (4).

In step 208, the CPU 172 causes "LED2" or the right LED 128' to emit light. In step 209, the CPU 172 calculates the X and Y position coordinates of the light spot 148' based on equations (1) and (2), or (5) and (6), and therefrom, calculates the X and Y axis coordinates of the LED 128' based on equation (8). In steps 210 and 212, the CPU 172 determines the horizontal and vertical angles $\phi H_2$ and $\phi V_2$ for the second LED 128' based on equations (3) and (4), all respectively. In step 114, since the LEDs 128 and 128' are centered over the origin as described above with respect to FIG. 19, the CPU 172 determines the X and Y position coordinates of the handle 102 based on equation (11). After determining the horizontal and vertical angles from the left and right LEDs 128 and 128' in steps 204, 206, 210 and 212, the CPU 172 calculates in step 216 the Z axis coordinate of the plate 108 based on equation (10). Alternatively, or additionally, in step 218, the CPU 172 can determine the angle of rotation $\theta$ based on equation (12) if the input device 100 employs the optical transducer 124. If the input device 100 employs the optical transducer 124', then the CPU 172 employs equation (13) to determine the angle of rotation $\theta$.

The CPU 172 can also determine the position of the slidable member 161, if such slidable member is employed in the input device 100. Therefore, in step 220, the CPU 172 provides an appropriate signal to "LED3" or the LED 163, causing it to emit light. In step 222, the CPU 172 determines a position of the slidable member 161 based on equations (1) or (5).

In step 224, the CPU 172 outputs the X, Y, Z and θ position coordinates to the computer 182. The CPU 172 in step 224 can scale the position coordinates to a particular value suitable for a given application. Alternatively, the position coordinates can be convened into an appropriate format required by the computer 182. For example, the CPU 172 can convert the digital position coordinates into analog signals using a resistor network, where the analog signals mimic signals output by variable resistors in current joysticks. Such a system is described in detail in a U.S. patent application entitled SYSTEM AND METHOD FOR THE SOFTWARE EMULATION OF A COMPUTER JOYSTICK, Ser. No. 08/509,444, filed Jul. 31, 1995.

In step 224, the CPU 172 also outputs to the computer 182 any switch signals or variable signals respectively generated by the switches 105 or slidable member 161. The CPU 172 preferably outputs to the computer 182 the switch signals, variable signals and position signals as digital signals that are repeatedly transmitted to the computer in the form of data packets having a preselected format. The computer 182 repeatedly receives the position coordinates, switch signals and variable signals as digitized signals in the preselected format, and therefore a variety of applications can use such signals without additional interpretive routines. The details on the format of such data packets and systems for generating such signals are described in detail in U.S. patent application entitled SYSTEM AND METHOD FOR DYNAMIC DATA PACKET CONFIGURATION, Ser. No. 08/509,364, filed Jul. 31, 1995, and U.S. patent application entitled SYSTEM AND METHOD FOR BIDIRECTIONAL DATA COMMUNICATION IN A GAME PORT, Ser. No. 08/509,081, filed Jul. 31, 1995, now U.S. Pat. No. 5,628,686, issued May 13, 1997.

As noted above, the input device 100 of the present invention is capable of determining the position of the handle 102 with great accuracy. A high-speed or specifically designed, and thus costly, CPU 172 is required to rapidly and accurately compute the number of trigonometric functions required under the above equations. However, in many applications such as for use with computer or TV games, accuracy is less important than reduced cost. By reducing the number of trigonometric calculations required by the CPU 172, a lower performance CPU can be used that still provides sufficient accuracy.

Based on the joystick environment, several assumptions can be made to reduce the number of trigonometric calculations required. Assuming that the plate 108 has a limited range of movement within the operating plane 112, then the X, Y and Z axis range of movement of the plate is small compared to the distance from the plate to the light detecting unit 126. Assuming also that the distance d between the LEDs 128 and 128' is substantially shorter than the distance from the LEDs to the light detecting unit 126, then certain approximations below can be made.

Based on the assumptions, the vertical angle $\phi V$, or $\phi V_2$ of a given LED 128 or 128' is approximately equal to the absolute value of the difference between the horizontal angles $\phi H_1$ and $\phi H_2$ the two LEDs. Therefore, the following approximation of the Z axis coordinates of the plate 108 results:

$$z=d\cdot\tan(|\phi H_1-\phi H_2|)\approx d\cdot|\phi H_1-\phi H_2| \tag{14}$$

Based on equation (14), further approximations can be carried out based on equations (7) and (8) to provide the following equations:

$$Px_1=z\cdot\tan(\phi H_1)\approx z\cdot\phi H_1;\ Py_1=z\cdot\tan(\phi V_1)\approx z\cdot\phi V_1;\ \text{and} \tag{15}$$

$$Px_2=x\cdot\tan(\phi H_2)\approx z\cdot\phi H_2;\ Py_2=z\cdot\tan(\phi V_2)\approx z\cdot\phi V_2. \tag{16}$$

Similarly, in lieu of equations (12) and (13), the angle of rotation $\theta$ can be approximated as follows:

$$\theta=\tan^{-1}\left(\frac{Py_1-Py_2}{Px_1-Px_2}\right)\cong\frac{Py_1-Py_2}{Px_1-Px_2} \tag{17}$$

Consequently, based on the above approximations, the four coordinate positions of the handle 102 can be determined by simple multiplication and division, without employing trigonometric functions. As a result, the computational load on the CPU 172 is greatly reduced, allowing for a less expensive CPU to be employed in the input device 100.

Rather than employing the simplifications of equations (14) through (17), the input device 100 can use a lookup table for the trigonometric functions. The lookup table can have only a limited number of entries based on the limited range of movement of the handle 102. For example, in a joystick environment, the handle 102 preferably has a maximum angle of rotation of +/−15° due to ergonomic constraints of the human hand. Therefore, the inverse tangent function to determine the angle of rotation θ will have only entries for angles between 0° and 30°.

In addition to the simplifications of equations (14) through (17), if the input device 100 is simplified to reduce the degrees of freedom of the handle 102. For example, if the handle 102 is to move only along the X, Y and Z axes, then the calculations for determining the angle of rotation θ are unnecessary. As a result, step 218 in the method 200 can be omitted during each iteration of the method.

Figure 25:
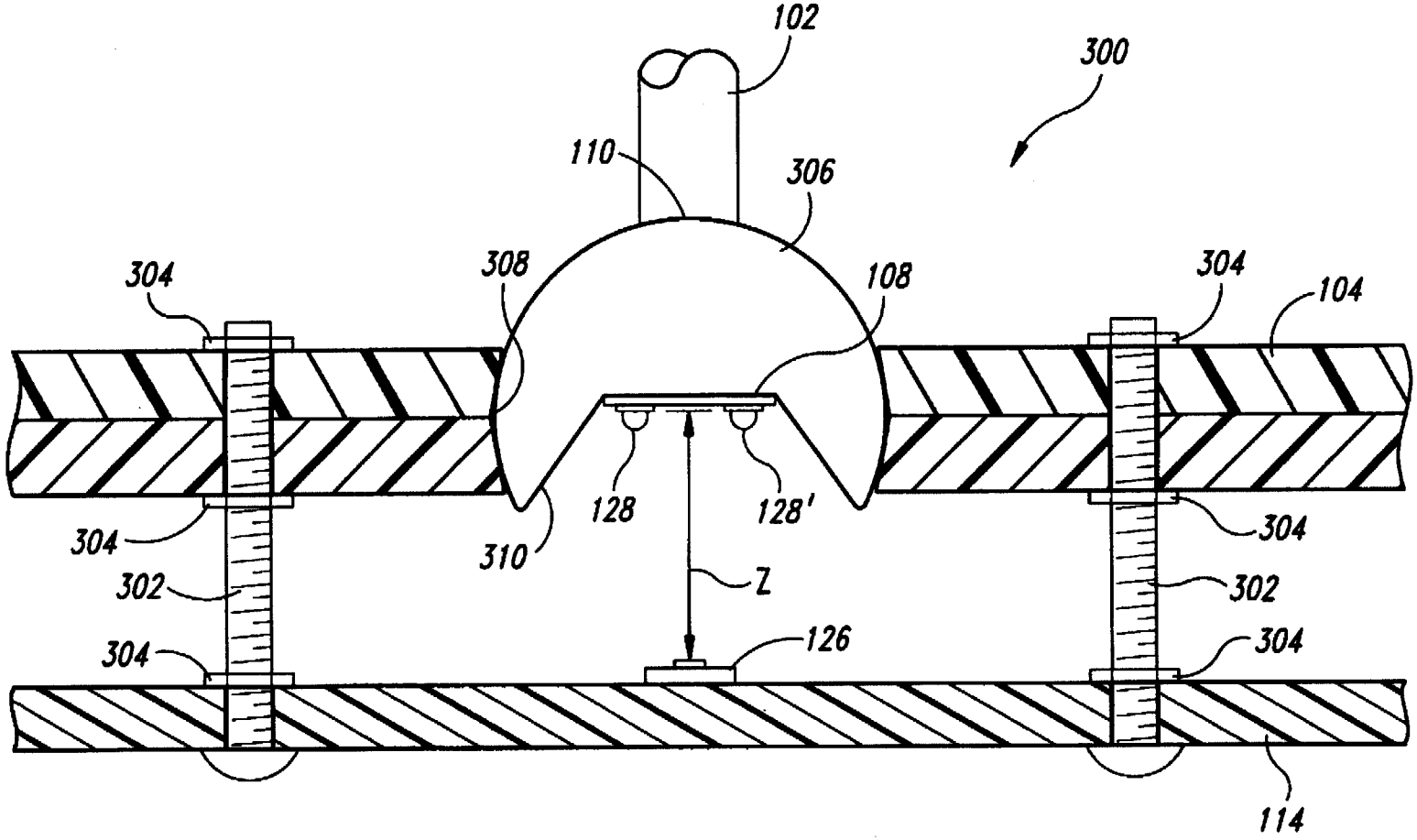
FIG. 25 is a side elevational, cutaway view of an alternative embodiment of the computer input device of FIG. 1.

Similarly, if the handle 102 is to move only along the X and Y axis and rotate about the Z-axis, then a constant Z axis position can be used, and the equations (10) or (14) for calculating the Z axis position can be omitted. As a result, step 216 in the method 200 can be omitted during each iteration of the method. For example, as shown in FIG. 25, a first alternative embodiment of the input device 100, shown as system 300, has a threaded post 302 that extends vertically from the base 114 to an upper portion of the housing 104. Nuts 304 or other suitable adjustable fasteners are adjustably received by the threaded post 302 to allow a fixed height Z to be maintained between the LEDs 128 and 128', and the light detecting unit 126. The nuts 304 can be moved along the threaded post 302 to adjust the fixed height Z.

A rotatable ball member 306 is retained at the first end 110 of the handle 102. An ellipsoid-like aperture 308 is formed in the upper housing 104, in which the ball member 306 is rotatably seated. As a result, the ball member 306 may rotate along X and Y axis directions, and may rotate at the rotation angle θ about the Z axis, but is restricted from moving along the Z axis.

The plate 108 is received within a downward facing opening 310 that expands from a midpoint of the ball 306 downward toward the light detecting unit 126. The LEDs 128 and 128', and the plate 108 are preferably positioned in the opening 310, at the midpoint of the ball 306, so that the plate 308 maintains an approximately parallel posture with the base 114, despite movement of the ball 306.

As explained above, the input device 100 of the present invention employs the handle 102 coupled to one portion of the optical transducer unit 124 or 124', i.e., coupled to either the pair of light-emitting diodes 128 and 128' or to the light-detecting unit 126. The other portion of the optical transducer 124 or 124' is mounted stationary within the housing 104, so that the handle 102 and the one portion of the optical transducer 124 or 124' are not mechanically coupled to the other portion of the transducer. The input device 100 of the present invention, under the method 200, is able to calculate the absolute, as opposed to relative, position along X, Y, and Z axes and the rotation angle θ about the Z axis, of the handle 102 based on light alternately received from the LEDs 128 and 128', without the need for additional circuitry. Therefore, if the input device 100 were powered down and then restarted, the system would be able to immediately determine and provide the absolute position 102 without calibration. No prior knowledge (e.g., counts as in a mouse) are required to determine position.

Those skilled in the art will recognize that the above-described invention provides a computer input device for providing multi-dimensional position coordinates and other signals to a computer or other device. Although specific embodiments of, and examples for, the present invention have been described for purposes of illustration, various modifications can be made without departing from the spirit and scope of the invention. For example, while the present invention is generally described above for use in a joystick for inputting signals to a computer, the present invention may be readily adapted for controlling robotic equipment or be used in other industrial applications:

Additionally, while the present invention has been described above as determining the four position coordinates along X, Y, and Z axes and rotation about the Z axis, the present invention can be modified to provide additional position coordinates such as rotation about the X axis. Furthermore, the input device 100 is generally described herein as constructed to cause the light spots 148 and 148' to move about the active surface of the photodiode 132 or PSD 136 or 140 with corresponding movement of the handle 102. However, additional optics or processing circuitry can be added to the present invention so that the light from the LEDs 128 and 128' do not emit light directly to the light detecting unit 126. The handle 102, coupling 106 and housing 104 can be constructed so that movement of the handle corresponds to opposite movement of the light spots 148 and 148' (e.g., leftward movement of the handle causes rightward movement of the light spots).

U.S. patents and applications cited above are incorporated herein by reference as if set forth in their entirety.

While the present invention is generally described above as determining the absolute position of a handle movably retained by the housing 104, the present invention can be readily adapted to provide position signals for the absolute position of a universally movable unit, which transmits or receives light from a stationary receiver unit. The universally movable unit contains either the LEDs 128 and 128' or the light detecting unit 126, coupled to appropriate driving circuitry, including a portable power supply. The present invention can determine the absolute position, with 6 degrees of freedom, of the universally movable member, that is, movement along X, Y and Z axes, and rotation about each of these axes (i.e., roll, pitch, and yaw). Accordingly, the present invention is not limited by the disclosure, but instead its scope is to be determined by reference to the following claims.

We claim:

1. A computer input apparatus for providing signals to a computer, comprising:

a housing having an interior;

an elongated member retained by the housing and movable along at least two of three perpendicular axes and rotatable about at least one of the three axes, the elongated member having a first end portion movably retained by the housing and a free end portion movable by a user along the two of three axes and rotatable about the one axis;

first and second light emitting elements within the interior of the housing and retained by one of the housing and the first end portion of the elongated member;

a light detecting element within the interior of the housing and retained by the other of the housing and the first end portion of the elongated member, the first and second light emitting elements projecting light to illuminate first and second areas on a surface of the light detecting element, and the light detecting element detecting the first and second illuminated areas and producing first and second signals respectively, in response thereto, the first and second signals corresponding to positions of the first and second illuminated areas, respectively, on the surface of the light detecting element; and processing circuitry electrically coupled to the first and second light emitting elements and the light detecting element to alternately cause the first and second light emitting elements to emit light, the processing circuitry receiving the first and second signals produced in response thereto, and producing a first position signal based on the first and second signals, the first position signal corresponding to a spatial position of the elongated member along the two of three axes and a rotational position based on rotation of the elongated member about the one axis.

2. The computer input apparatus of claim 1, further comprising:

a movable member retained by the housing having a first end selectively movable by a user and a free end;

a third light emitting element within the interior of the housing and coupled to the free end of the movable member, the third light emitting element projecting light to illuminate a third area on the surface of the light detecting element, the light detecting element detecting the third illuminated area and producing a third signal in response thereto, the third signal corresponding to the position of the third illuminated area on the surface of the light detecting element; and wherein the processing circuitry alternately causes the first, second and third light emitting elements to emit light, receives the first, second and third signals produced in response thereto, and produces second position signal based on the third signal, the third signal corresponding to the spatial position of the movable member.

3. The computer input apparatus of claim 1, further comprising at least one switch retained by the housing and coupled to the processing circuitry, and wherein the processing circuitry provides a switch signal to the computer in response to actuation of the switch.

4. The computer input apparatus of claim 1 wherein the processing circuitry produces the first position signal as a digital signal and provides the digital first position signal to the computer.

5. The computer input apparatus of claim 4 wherein the processing circuitry repeatedly produces, and provides to the computer, data packets containing the digital first position signal.

6. The computer input apparatus of claim 1 wherein the processing circuitry includes a central processing unit and an analog-to-digital converter coupled between the central processing unit and the light detecting element, the analog-to-digital converter converting the first and second signals to first and second digital signals to the central processing unit, and the central processing unit producing the first position signal as a digital signal to the computer.

7. The computer input apparatus of claim 1 wherein the light detecting element is a two-dimensional position sensing device.

8. The computer input apparatus of claim 1 wherein the light detecting element is a four quadrant photodiode.

9. The computer input apparatus of claim 1, further comprising amplification circuitry coupled between the light detecting element and the processing circuitry, and wherein the light detecting element is monolithically integrated with the amplification circuitry.

10. The computer input apparatus of claim 1 wherein the light detecting element includes first and second one-dimensional position sensing devices positioned mutually perpendicular to each other.

11. The computer input device of claim 1 wherein the housing is substantially closed to restrict ambient light from entering into the interior of the housing.

12. The computer input device of claim 1 wherein the elongated member is pivotally retained by the housing substantially at a pivot point proximate to the first end portion, whereby the first end portion has a more restricted range of movement along the two of three axes than the free end portion.

13. The computer input apparatus of claim 1, further comprising at least one apertured plate retained within the housing, in position between the light detecting element and the first and second light emitting elements.

14. The computer input device of claim 13 wherein a distance between the apertured plate and the light detecting element is less than a distance between the first and second light emitting elements and the light detecting element.

15. The computer input device of claim 1, further comprising a substantially planar member secured to the first end portion of the elongated member, the planar member retaining the one of the light detecting element and the first and second light emitting elements, and wherein the planar member is movable substantially parallel to a plane in the housing, the plane in the housing retaining the other of the light detecting elements and first and second light emitting elements.

16. The computer input device of claim 15 wherein the planar member is movable along the two of three axes a maximum first distance, and wherein the planar member and the plane in the housing are separated by a second distance, and wherein the second distance is greater than the first distance.

17. The computer input device of claim 15 wherein the first and second light emitting elements are separated by a first distance, and wherein the planar member and the plane in the housing are separated by a second distance, and wherein the second distance is greater than the first distance.

18. The computer input device of claim 15 wherein the elongated member is movable along the three perpendicular axes, and wherein the first position signal corresponds to a spatial position of the elongated member along the three perpendicular axes.

19. The computer input device of claim 1 wherein the light detecting element directly receives the projected light illuminating the first and second illuminated areas, and wherein the first and second light emitting elements are positioned equidistantly from the light detecting element when the elongated member is in coaxial alignment with one of the three axes.

20. The computer input device of claim 1 wherein the elongated member is movable along the three perpendicular axes, and wherein the first position signal corresponds to a spatial position of the elongated member along the three perpendicular axes.

21. An input apparatus for providing absolute position signals comprising:

a stationary housing;

a movable member movable in at least three degrees of freedom;

an optical transducer having a first portion that includes first and second light emitting elements and a second portion that includes at least one light detecting element, one of the first and second portions of the optical transducer being within the stationary housing and the other of the first and second portions of the optical transducer being retained by the movable member;

the first and second light emitting elements projecting light to illuminate respective first and second areas on the light detecting element, and the light detecting element detecting the first and second illuminated areas of light and producing first and second signals, respectively, in response thereto, the first and second signals uniquely corresponding to positions of the first and second illuminated areas of light, respectively, on the light detecting element;

processing circuitry electrically coupled to one of the first and second portions of the optical transducer;

driving circuitry electrically coupled to the other of the first and second portions of the optical transducer; and the driving circuitry causing the first and second light emitting elements to emit light, and the processing circuitry receiving the first and second signals produced in response thereto, and producing a first position signal based on the first and second signals, the first position signal corresponding to an absolute position of the movable member with respect to the three degrees of freedom.

22. The input apparatus of claim 21 wherein the movable member retains the first portion of the optical transducer, and wherein the first and second light emitting elements are light emitting diodes.

23. The input apparatus of claim 22 wherein the movable member includes a slidable member having a third light emitting element secured thereto, the third light emitting element projecting light to illuminate a third area of light on the surface of the light detecting element, the light detecting element detecting the third illuminated area and producing a third signal in response thereto, the third signal corresponding to the position of the third illuminated area on the surface of the light detecting element; and wherein the driving circuitry alternately causes the first, second and third light emitting elements to emit light, and wherein the processing circuitry receives the first, second and third signals in response thereto, and produces a second position signal based on the third signal, the third position signal corresponding to the position of the spatial slidable member.

24. The input apparatus of claim 21 wherein the movable member has a first end portion movably retained by the stationary housing and a free end portion movable by a user, wherein the stationary housing has an interior and the one of the first and second portions of the optical transducer is positioned within the interior of the stationary housing, and wherein the other of the first and second portions of the optical transducer is retained by the first end portion of the movable member.

25. The input apparatus of claim 24 wherein the movable member is an elongated member pivotally retained by the housing substantially at a pivot point proximate to the first end portions, whereby the first end portion has a more restricted range of movement than the free end.

26. The input apparatus of claim 24 wherein the movable member includes a substantially planar member secured to the first end portion of the movable member, the planar member retaining the other of the first and second portions of the optical transducer, and wherein the planar member is movable substantially parallel to a plane of the stationary housing, the one of the first and second portions of the optical transducer being retained in the plane in the housing.

27. The input apparatus of claim 21 wherein the second portion of the optical transducer includes an apertured plate positioned between the light detecting element and the first and second light emitting elements, and wherein a distance between the apertured plate and the light detecting element is less than a distance between the light detecting element and the first and second light emitting elements.

28. The input apparatus of claim 21 wherein the movable member is movable along at least two perpendicular axes, wherein the light detecting element directly receives the projected light illuminating the first and second areas, and wherein the first and second light emitting elements are positioned equidistantly from the light detecting element when the movable member is in coaxial alignment with one of the two axes.

29. The input apparatus of claim 21 wherein the movable member is movable in six degrees of freedom, and wherein the first position signal corresponds to the absolute position of the movable member about the six degrees of freedom.

30. The input apparatus of claim 21 wherein the first and second light emitting elements are separated by a first distance, wherein the first and second light emitting elements and the light detecting element are separated by a second distance, wherein the movable member is movable in at least two of the three degrees of freedom by a maximum of a third distance, and wherein the second distance is greater than the first and the third distance.

31. The input apparatus of claim 21 wherein the processing circuitry produces the first position signal as a digital signal.

32. The input apparatus of claim 21 wherein the processing circuitry includes a central processing unit and an analog-to-digital converter coupled between the central processing unit and the light detecting element, the analog-to-digital converter converting the first and second signals to first and second digital signals to the central processing unit, and the central processing unit producing the first position signal as a digital signal to the computer.

33. In a computer input device having first and second light emitting elements, a light detecting element and an elongated member movable along at least two of three mutually perpendicular axes and rotatable about at least one of the three axes, a method of computing coordinates of a position of the elongated member comprising the steps of:

moving the elongated member;

projecting light from the first light emitting element to the light detecting element following movement of the elongated member;

determining a first incident direction of light from the first light emitting element to the light detecting element;

projecting light from the second light emitting element to the light detecting element;

determining a second incident direction of light from the second light emitting element to the light detecting element;

determining a spatial position of the elongated member along the two of three mutually perpendicular axes based on the determined first and second incident directions of light from the respective first and second light emitting elements;

determining a rotational position of the elongated member about the one of the three axes based on the determined first and second incident directions of light from the respective first and second light emitting elements; and outputting the spatial and rotational positions to a computer.

34. The method of claim 33 wherein each of the steps of determining first and second incident directions of light include the steps of:

directly receiving a light spot on the light detecting element;

determining a position of the light spot on the light detecting element;

determining an incident horizontal angle of the projected light based on the position of the light spot; and determining an incident vertical angle of the projected light based on the position of the light spot.

35. The method of claim 34 wherein the step of determining a spatial position determines the spatial position of the elongated member along the three mutually perpendicular axes based on the determined first and second incident directions of light from the respective first and second light emitting elements.

36. The method of claim 34 wherein the step of determining a rotational position determines a rotational position of the elongated member about two of the three mutually perpendicular axes.

37. The method of claim 33 wherein the computer input device includes a movable member having a third light emitting element, the method further including the steps of:

projecting light from the third light emitting element to the light detecting element, following movement of the movable member, to produce a light spot on the light detecting element; and determining a position of the movable member based on a position of the light spot on the light detecting element.

38. The method of claim 33 wherein the step of outputting the spatial and rotational positions outputs digital signals representing the spatial and rotational position of the elongated member to the computer.

* * * * *